US005682825A

United States Patent [19]

Manner

[11] Patent Number: 5,682,825

[45] Date of Patent: Nov. 4, 1997

[54] HEIGHT-ADJUSTABLE WORK TABLE

[75] Inventor: Roland Manner, Weilheim/Teck, Germany

[73] Assignee: Robert Krause GmbH & Co. KG Zweignniederlassung Weilheim/Teck, Weilheim/Teck, Germany

[21] Appl. No.: 395,868

[22] Filed: Feb. 28, 1995

[30] Foreign Application Priority Data

Mar. 1, 1994 [DE] Germany ..... 44 06 550.7
Feb. 15, 1995 [DE] Germany ..... 195 04 910.1

[51] Int. Cl.[6] ..... A47B 9/00

[52] U.S. Cl. ..... 108/144; 108/147; 248/123.11; 248/125.2

[58] Field of Search ..... 108/144, 146, 108/147; 248/123.11, 123.2, 125.2

[56] References Cited

U.S. PATENT DOCUMENTS

| | | | |
|---|---|---|---|
| 3,820,176 | 6/1974 | Feiertag | 108/147 X |
| 3,828,694 | 8/1974 | Nestler et al. | 108/10 |
| 3,896,744 | 7/1975 | Goebl | 108/146 |
| 4,351,245 | 9/1982 | Laporte | 108/144 X |
| 4,607,577 | 8/1986 | Leonardo | 108/144 |
| 4,898,103 | 2/1990 | Pontoppidan et al. | 108/144 |
| 4,981,085 | 1/1991 | Watt | 108/146 X |
| 5,289,782 | 3/1994 | Rizzi et al. | 108/147 |
| 5,311,827 | 5/1994 | Greene | 108/147 |

FOREIGN PATENT DOCUMENTS

| | | | |
|---|---|---|---|
| 1429534 | 1/1969 | Germany | 108/147 |
| 2836134 | 2/1980 | Germany | 108/144 |
| 3239357 | 4/1984 | Germany . | |

*Primary Examiner*—Peter M. Cuomo
*Assistant Examiner*—Janet M. Wilkens
*Attorney, Agent, or Firm*—Robert W. Becker & Associates

[57] ABSTRACT

A height-adjustable work table has a support frame with at least one telescopic column having at least one support slidably displacable in the telescopic column. The work table has a table top and a weight-compensating device comprising at least one force reservoir and a pulling cable for adjusting the height of the support is provided. A force compensating device is connected to the weight-compensating device. The force reservoir has a first and a second end whereby the first end of the force reservoir is connected to the support frame and the second end is connected to the force compensating device. The weight-compensating device cooperates with the force compensating device such that for displacing the support the effective leverage of the force-compensating device is adjustable such that a counterforce generated by the weight-compensating device is at least partially compensated.

32 Claims, 18 Drawing Sheets

HEIGHT-ADJUSTABLE WORK TABLE

BACKGROUND OF THE INVENTION

The present invention relates to a height-adjustable work table comprising at least one telescopic column in which at least one support is slidable. The work table further comprises a weight-compensating device that has at least one force-compensating device the end of which is supported at the frame of the work table and the other end of which is connected with a pulling cable to the support for height-adjustment.

In this known work table the weight-compensating device has a force-reservoir in the form of a tension spring with which the counter force needed for weight compensation is provided. It prevents that the table top of the work table after release of the supports can suddenly drop. The higher the weight, the stronger the tension spring must be tensioned; however, the higher the tension of the tension spring, the greater the length of it. Furthermore, since the spring characteristic line increases greatly with increasing tension of the tension spring, the user of the work table must exert a correspondingly high force corresponding to the great tension of the tension spring in order to be able to adjust the table top in the downward direction. When high weights are to be compensated, a relatively long tension spring must be used. Thus, a tension spring can only be used in such work tables that have a transverse beam of a corresponding length. However, it is often necessary to provide smaller work tables, especially in the computer field, in which such a weight-compensation device with a long tension spring cannot be used.

It is therefore an object of the present invention to provide and improve a work table of the aforementioned kind such that even for a small length a reliable weight compensation is ensured.

SUMMARY OF THE INVENTION

The height-adjustable work table according to the present invention is primarily characterized by:

A support frame comprising at least one telescopic column having at least one support slidably displacable in the telescopic column;

A table top connected to the support;

A weight-compensation device comprising at least one force reservoir and a pulling cable for adjusting the height of the support;

A force-compensating device connected to the weight-compensating device;

The force reservoir having a first and a second end, wherein the first end of the force reservoir is connected to the support frame and the second end is connected to the force compensating device; and The weight-compensating device cooperating with the force-compensating device such that for displacing the support the effective leverage of the force-compensating device is adjustable such that a counter-force generated by the weight-compensating device is at least partially compensated.

Preferably, the force-compensating device has at least one adjusting element and a tensioning cable, wherein the adjusting element comprises a support element for supporting the tensioning cable.

Advantageously, the support element is a groove provided at a mantle surface of the adjusting element.

Expediently, the adjusting element has the shape of a sector.

Preferably, the adjusting element is a one-arm lever.

Preferably, the adjusting element is pivotable about a pivot axis. In a preferred embodiment of the present invention, the support element extends concentric to the pivot axis over a portion of a circular arc. Preferably, the support element extends over an angle of at least 90°.

Expediently, the force-compensating device further comprises a rotatable shaft and an adjusting lever, wherein the adjusting element and the adjusting lever are fixedly connected on the rotatable shaft.

Preferably, the adjusting lever comprises two legs. Expediently, the adjusting lever is U-shaped.

In a preferred embodiment of the present invention each one of the legs comprises a slotted hole extending in a longitudinal direction of each leg. The force-compensating device comprises a bearing bolt that engages the slotted holes. The force reservoir is connected to the bearing bolt.

Preferably, the bearing bolt has a threaded bore and the adjusting device further comprises an adjusting shaft on which the rotatable shaft is supported. A threaded spindle with a first and a second end is provided wherein the first end is received in the threaded bore of the bearing bolt. A bevel gear system is connected between the second end of the threaded spindle and the adjusting shaft.

Advantageously, the force reservoir comprises at least one gas spring. In the alternative the force reservoir comprises at least one tension spring or at least one pressure spring.

In another embodiment of the present invention the work table further comprises at least one arresting device for arresting the support relative to the at least one column. The at least one arresting device comprises a push/pull rod positioned in one of the columns and at least one locking disk connected to an upper end of the push rod. A first toothing is connected to the support positioned in the column. A second toothing is connected to the at least one disk, wherein the first and second toothings cooperate with one another for arresting the support relative to the column. Preferably, the at least one locking disk is movable into a release position by moving the push/pull rod. Advantageously, the column comprises a stay forming a floor support for the work table. A lever with two arms is positioned in the stay and a first one of the two arms is connected to the push/pull rod. An actuating device for pivoting the lever is provided.

Preferably, the actuating device is in the form of an actuating member that projects upwardly past the stay and engages the second one of the two arms.

The actuating device in another embodiment of the present invention is a Bowden pull comprising a pull cable. The Bowden pull comprises an actuating handle. The actuating handle comprises a holder and a grip mounted in the handle so as to be pivotable. The holder is preferably connected to the underside of the table top.

The actuating device further comprises a slide connected to the first arm of the lever wherein the pull cable is connected to the slide. Advantageously, the slide has at least one angled end and the lever comprises a coupling part to which the angled end is connected.

In another embodiment of the present invention the angled end is forked and the coupling part has an upwardly extending head that is engaged by the forked, angled end.

Preferably, the column has a support member for the push/pull rod and the slide engages the support member.

In yet another embodiment of the present invention the force reservoir is connected with a tensioning cable to the adjusting element.

Advantageously, the work table further comprises a transverse beam connecting at least two of the columns, wherein the force compensating device is positioned in the transverse beam.

Preferably, the work table comprises only one of the columns and the force compensating device is positioned in this column.

In another embodiment of the present invention the work table comprises two of the columns and further comprises a parallel guide system connected to the supports.

In the inventive work table the force-compensating device is positioned between the force reservoir and the pulling cable whereby the force-compensating device at least approximately compensates the increase of force of the force reservoir. Thus it is ensured that even at high weight forces the user of the work table can displace the table top downwardly while exerting only small forces. Due to the force compensating device it is possible to employ short force reservoirs. When such a force reservoir is, for example, in the form of a tension spring it is possible easily possible to expand it to a great extent because the force-compensating device ensures that the resulting great spring force is compensated. Thus, it is possible that the table top during height-adjustment can be pushed downwardly with a small force. The force-compensating device can be adjusted by the user without problems such that the required weight compensation is ensured.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
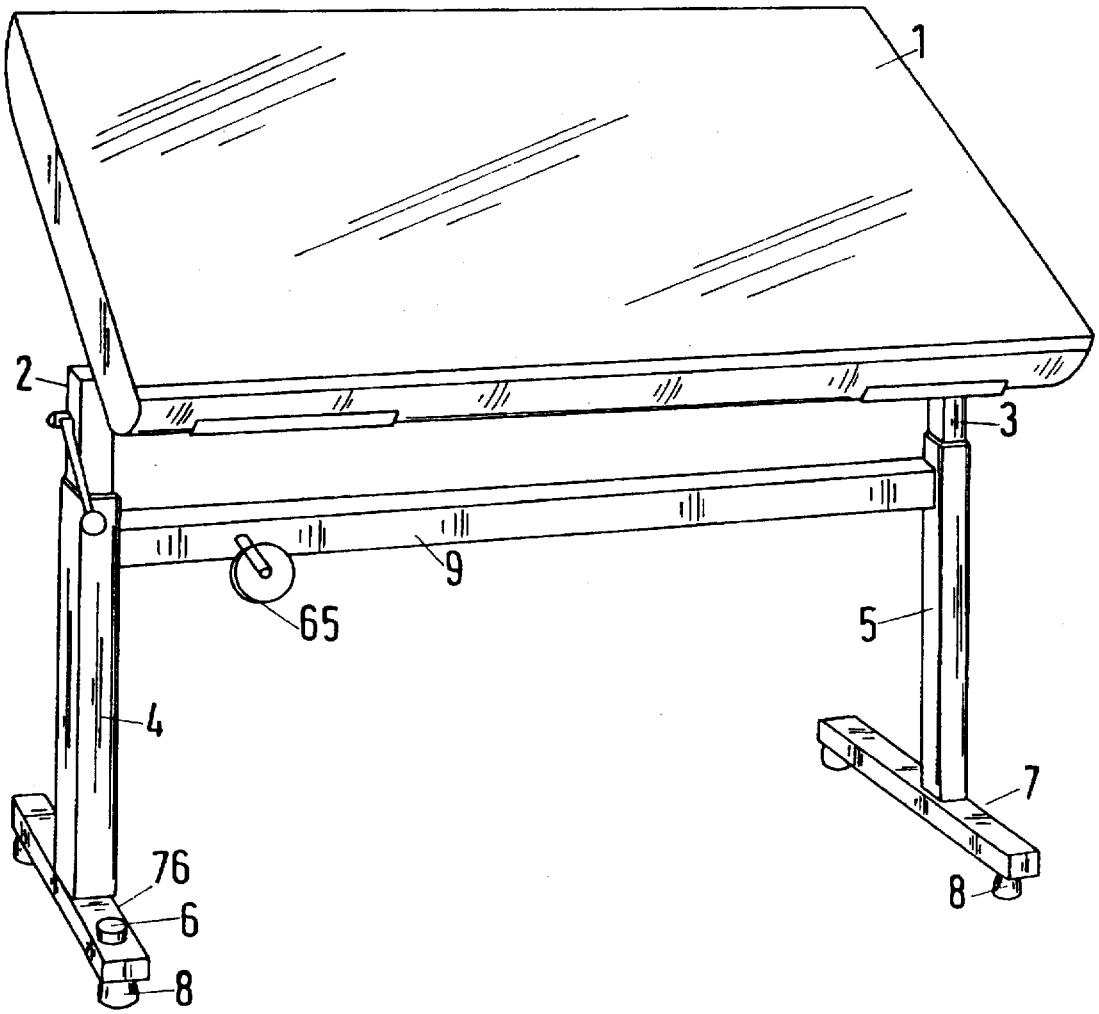
FIG. 1 shows in a schematic representation the inventive height-adjustable work table.

The present invention will now be described in detail with the aid of several specific embodiments utilizing FIGS. 1 through 21.

In the shown embodiment the work table is a drafting table the table top 1 of which is adjustable in its height and slant. The work table can also be a computer table, a desk-type table etc. The table top 1 may also be designed so as to be only adjustable with respect to its height. The table top 1 is supported by two supports 2 and 3 arranged respectively at its narrow sides. The supports 2, 3 are guided in vertical columns 4 and 5 and are continuously adjustable in their longitudinal direction. The columns 4 and 5 are supported on horizontal stays 6 and 7 (floor supports) that may rest directly on the floor or, as shown may be provided with coasters 8 at their ends which may be advantageously designed so as to function as leveling screws. The two columns 4, 5 are connected with a hollow transverse beam 9 that is preferably attached by welding. The transverse beam 9 imparts to the support frame for the table top 1, comprised of the columns 4, 5, the stays 6, 7, and the transverse beam 9, the required stiffness and stability.

In order to be able to adjust the height of the table top 1 upwardly or downwardly together with its vertical supports 2, 3 without requiring substantial adjusting forces, the weight of the table top 1 is compensated by a weight-compensating device that is substantially positioned within the transverse beam 9.

Figure 2:
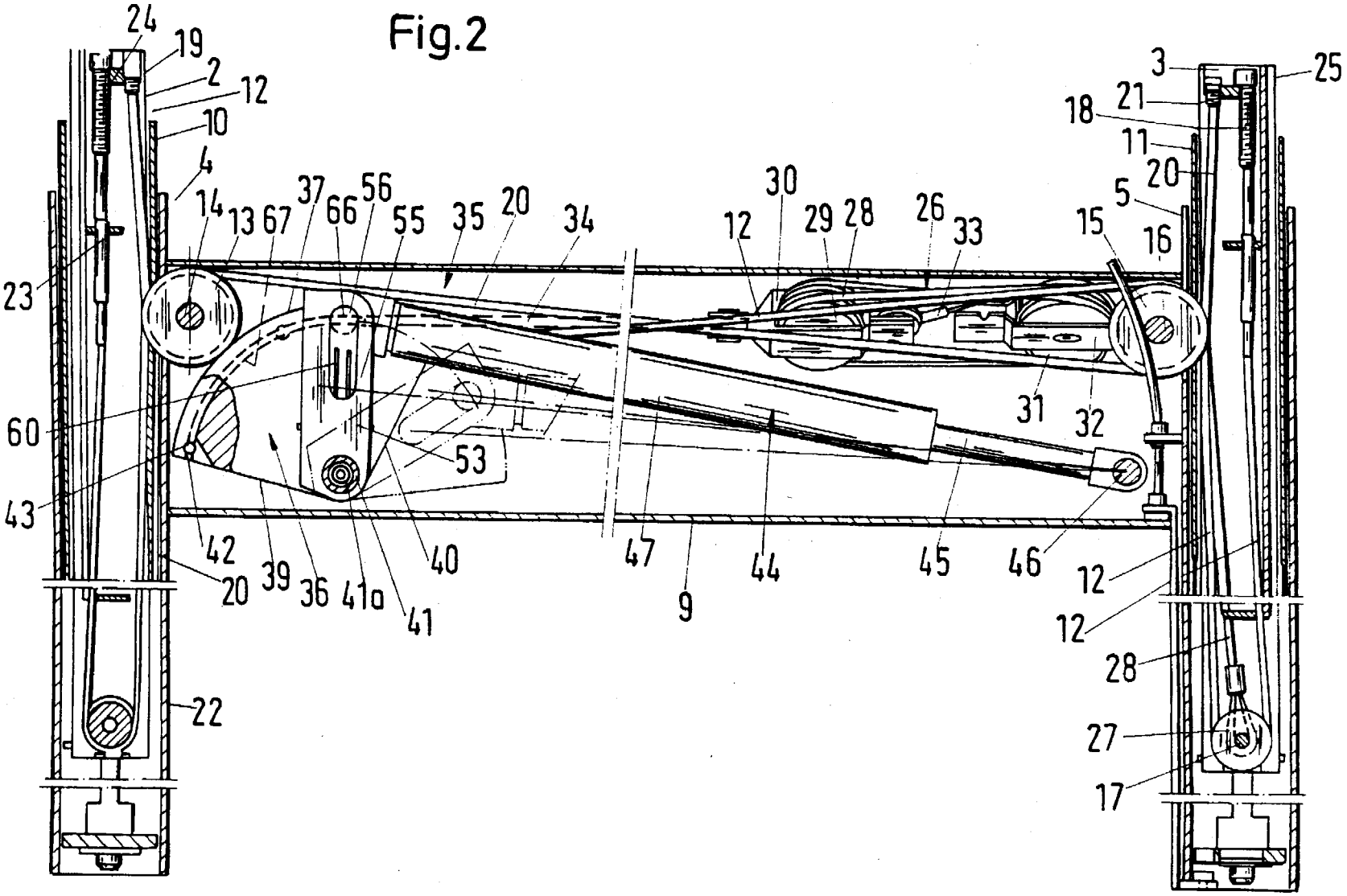
FIG. 2 shows a longitudinal section of the two supports and the transverse beam of the work table according to FIG. 1.

In the representation according to FIG. 1 the supports 2, 3 are guided directly within the columns 4, 5. However, it is also possible, as shown in FIG. 2, to guide the supports 2, 3 via intermediate tubes 10, 11 in the columns 4, 5. Since such an embodiment is known per se, it is not described in detail in this context.

Within the support 2 one end of a guide cable 12 is connected to the upper end of the support 2. The cable 12 extends within the support 2 downwardly and is guided about a freely rotatable guide pulley 13. The axle 14 of the guide pully 13 is connected within the transverse beam 9 in the vicinity of its transition into the column 4. The column 4 as well as the intermediate tube 10 are provided with a corresponding through opening for the guide cable 12. The guide cable 12 is guided coming from the bottom about the guide pulley 13 into the transverse beam 9 and extends within the transverse beam 9 to a guide pulley 15 connected to the other end of the transverse beam 9. The guide pulley 15 is freely rotatable about its axle 16 that is supported at the transverse beam 9. The axle 16 is positioned in the vicinity of the transition of the transverse beam 9 into the column 5. The guide pulley 15 extends, as does the guide pulley 13, to a limited extent into the corresponding support 3. The guide cable 12 is guided from the top across the guide pulley 15 into the support 3 so as to be downwardly deflected. At its lower end the support 3 is guided about a guide pulley 17 via which the guide cable 12 is deflected in the upward direction. The cable 12 is fastened with an adjusting screw 18 to the upper end of the support 3. The other end of the guide cable 12 is connected with a nipple 19 to the support 2.

The guide cable 12 is part of a compensation device with which it is ensured that the two supports 2, 3 can be adjusted synchronously with respect to their height. A second guide cable 20 is connected with a nipple 21 to the upper end of the support 3 (FIG. 2). The guide cable 20 is guided from the bottom about the guide pulley 15 into the transverse beam 9 and extends therein to the oppositely positioned guide pulley 13. At the guide pulley 13 the guide cable 20 is guided from the top into the support 2 within which it is guided downwardly to the guide pulley 22 that is supported at the lower end of the support 2. Here the guide cable 20 is deflected in the upward direction. It is connected with an adjusting screw 23 to the upper end of the support 2. With the two adjusting screws 18, 23 the two guide cables 12, 20 can be exactly and continuously adjusted, whereby the two guide cables 12, 20 ensure the uniform movement of the two supports 2, 3 during height adjustment.

Figure 3:
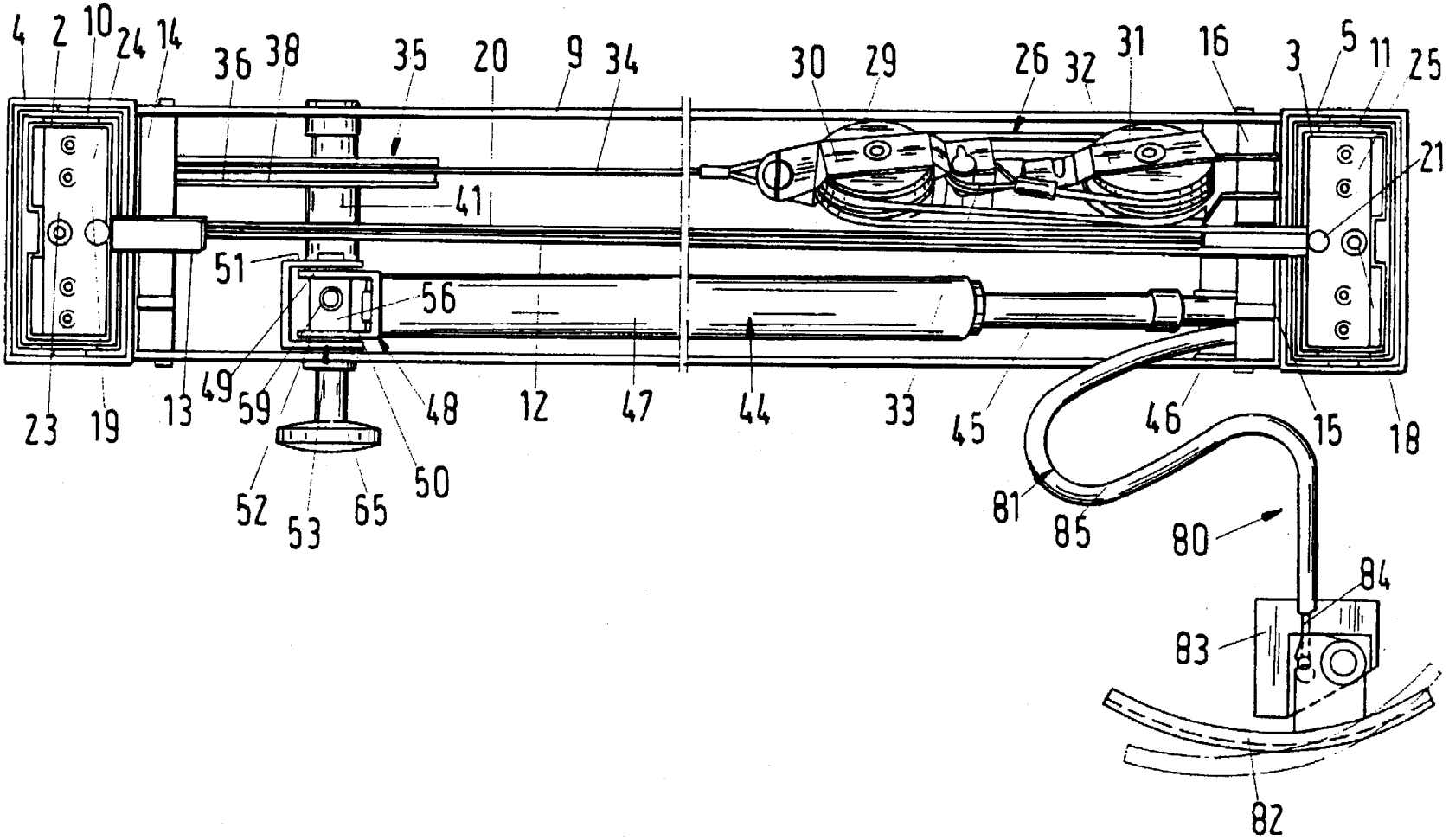
FIG. 3 shows a horizontal section of the supports and the transverse beam of the work table of FIG. 1.

For securing the adjusting screws 18, 23 and the nipples 19, 21 the supports 2, 3 are provided at their upper end with a plate 24, 25, that is preferably welded to the supports 2, 3 (FIG. 2 and 3).

The two guide pulleys 13, 15 are positioned, as shown as shown in FIG. 3, at half the width of the transverse beam 9 and close to its upper side (FIG. 2). The two axles 14, 16 of the guide pulleys 13, 15 extend parallel to one another and perpendicular to the longitudinal axis of the transverse beam 9.

The weight-compensating device for the table top 1 comprises a set of pulleys 26 that are positioned within the transverse beam 9 (FIGS. 2 and 3). The axle 27 which supports the guide pulley 17 at the support 3 has connected thereto one end of the pulling cable 28 which within the support 3 is upwardly guided and deflected by the guide pulley 15 or a separate guide pulley so as to be deflected into the transverse beam 9. In the shown embodiment the guide pulley 15 is provided with various grooves in which the two guide cables 12, 20 and the pulling cable 28 are positioned. The pulling cable 28 is deflected about the guide pulley 15 to a guide pulley 29 that is supported within a bracket 30 so as to be freely rotatable within the transverse beam 9. The pulling cable 28 is deflected by the guide pulley 29 to a second guide pulley 31 that is also freely rotatably supported in a bracket 32. The bracket 32 is seated on the axle 16 on which the guide pulley 15 is rotatably supported. The pulling cable 28 is guided twice about the two guide pulleys 29, 31 and is then connected with its end 33 to the bracket 30 of the guide pulley 29.

To the end of the bracket 30 that is facing away from the guide pulley 31 one end of a tensioning cable 34 is connected which is a part of the force-compensating device 35. The tensioning cable 34 is guided about an adjusting element 36 that is plate-shaped and sector-shaped. (Sector in the context of this invention is defined as in geometry: an area delimited by two radii and the arc of the circle resulting from the radii.) The adjusting element 36 may also have a circular contour. The adjusting element 36 has a mantle surface 37 (FIG. 2) that is curved corresponding to a portion of a circular arc. Over the length of the mantle surface 37 a support element in the form of a groove 38 (FIG. 3) is provided in which the tensioning cable 34 is supported over part of its length. The mantle surface 37 extends between two planar end faces 39 and 40 which in the shown embodiment enclose an obtuse angle between them. In the vicinity of the interception of the two end faces 39, 40, a shaft 41 is provided which extends parallel to the axles 14, 16 of the guide pulleys 13, 15 and which is supported in a rotatable manner on an adjusting shaft 41*a*. The adjusting shaft 41*a* is rotatably supported in the side walls of the transverse beam 9. The adjusting element 36 is fixedly connected to the shaft 41. In the vicinity of the transition of the end face 39, facing away from the set of pulleys 26, into the mantle surface 37 of the adjusting element 36, a catch opening 42 (FIG. 2) is provided at the end face 39 into which a catch element 43 can be inserted that is provided at the end of the tensioning cable 34 remote from the set of pulleys 26. The tensioning cable 34 is positioned in the groove 38 of the adjusting element 36 and extends to the bracket 30 of the set of pulleys 26. Depending on the position of the adjusting element 36 the tensioning cable 34 extends over a shorter or greater length within the groove 38. In FIG. 2 the two end positions of the adjusting element 36 are represented in solid and dashed-lines. The end position represented in solid lines shows the tensioning cable 34 with its greatest length being supported in the groove 38, while the end position in dashed lines represents the shortest length of the tensioning cable 34 being positioned in the groove 38 of the adjusting element 36, whereby the adjusting element 36 has been rotated in a clockwise direction into this end position. The groove 38 is positioned at a constant radius (concentric) about the axis of the shaft 41 so that upon rotation of the adjusting element 36 about the axis of the shaft 41 the distance of the tensioning cable 34 within the groove 38 from the shaft 41 remains unchanged. The shaft 41 and the adjusting shaft 41*a* are positioned close to the bottom of the transverse beam 9 (FIG. 2) so that the adjusting element 36 is essentially in an upright position.

Figure 4:
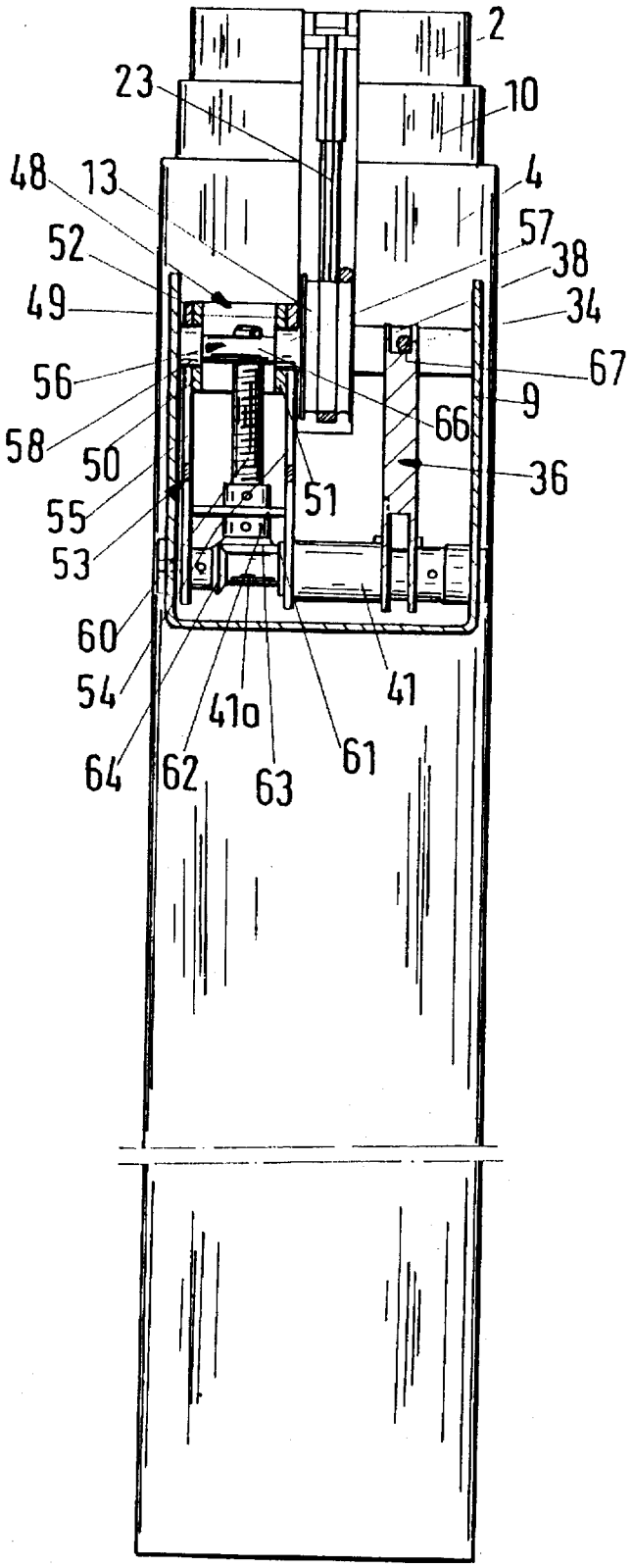
FIG. 4 shows a vertical section of the force-compensating device positioned in the transverse beam of the work table of FIG. 1.

As shown in FIG. 3, the adjusting element 36 and the set of pulleys 26 are located in one half of the transverse beam 9. A gas spring 44 is positioned in the other half of the transverse beam 9. The free end of its piston rod 45 is pivotably supported on an axle 46 that is supported within the transverse beam 9 and that extends parallel to the axles 14, 16 of the guide pulleys 13, 15. The axle 46 is provided in an area below the guide pulley 15 close to the transition of the transverse beam 9 into the column 5. At the opposite end the housing 47 of the gas spring 44 is connected to a U-shaped bracket 48 (FIG. 3). The two legs 49 and 50 of the bracket 48 extend in the direction toward the column 5 and which are positioned between the legs 51, 52 of an adjusting lever 53. As can be seen in FIGS. 2 and 4, the two legs 51, 52 of the adjusting lever 53 are each provided with a slotted hole 54, 55 extending in their longitudinal direction. The ends of a transverse bolt 56 are positioned in the holes 54, 55. The legs 49, 50 of the bracket 48 are supported on the transverse bolt 56. The transverse bolt 56 rests with its thick end portions 57 and 58, which in cross-section are circular, at the upper end of the slotted holes 54, 55 in the shown embodiment. The transverse bolt 56 is provided at half its length with a threaded bore 59 (FIG. 3) with which the transverse bolt 56 is seated on a threaded spindle 60 (FIG. 2 and FIG. 4). The threaded spindle 60 is rotatably supported with a bearing 61 (FIG. 4) in a bearing plate 62 that connects the legs 51 and 52 of the adjusting lever 53. At its lower end the threaded spindle 60 is provided with a gear wheel 63 that meshes with a gear wheel 64 fixedly connected to the adjusting shaft 41*a*.

As shown in FIG. 3, the adjusting shaft 41 can be rotated with a grip 65 about its axis. The grip 65 projects forwardly from the transverse beam 9 toward the user so that the user can easily turn the grip 65 and thus rotate easily the adjusting shaft 41*a*. Instead of providing such a grip 65 it is also possible to drive the adjusting shaft 41*a* with an electric motor. By rotating the grip 65 the threaded spindle 60 is rotated about its axis via the gear wheel system 63, 64 whereby, depending on the direction of rotation, the transverse bolt 56 is displaced within the slotted holes 54, 55. Since the transverse bolt 56 is connected non-displaceably to the bracket 48, the piston rod 45 of the gas spring 44 is pushed into or removed from the housing 47 as a function of the direction of displacement of the transverse bolt 56. Accordingly, the counterforce that is exerted by the gas spring 44 is increased or decreased. In this manner, the counterforce of the gas spring 44 can be easily adjusted to the weight of the table top 1. The greater the extent of insertion of the piston rod 45 into the gas spring 44, the greater is the resulting counterforce. As a function of the position of the transverse bolt 56 in the slotted holes 54, 55, the effective leverage of the force-compensating device 35 is thus adjusted corresponding to the weight of the table top 1.

It is, of course, also possible to rotate the threaded spindle 60 directly with a respective actuating member so that a gear system and an adjusting shaft are not necessary.

As shown in FIGS. 2 and 4, the axis 66 of the transverse bolt 56 is located at the level of the bottom 67 of the groove 38 in the mantle surface 37 of the adjusting element 36. Since the bottom 67 of the groove 38 has a contour in its longitudinal direction that corresponds to a portion of a circular arc concentric to the axis of the shaft 41, the distance between the shaft 41 and the bottom of the groove 67 does not change during pivoting of the adjusting element 36, respectively, of the adjusting lever 53. When the table top 1 is downwardly displaced, the adjusting element 36 and the adjusting lever 53, which are fixedly connected to the shaft 41, are pivoted via the tensioning cable 34 in FIG. 2 in a clockwise direction. This results in a change of the leverage of the adjusting lever 53 as a function of the pivot angle. In the position indicated with solid lines the adjusting lever 53 has a leverage that is defined by the distance between the axis of the transverse bolt 56 and of the shaft 41. In the position indicated with dashed lines in FIG. 2 the effective leverage is defined by the vertical distance between the axis of the transverse bolt 56 and a horizontal plane extending through the axis of the shaft 41. This effective leverage is thus substantially smaller than the first effective leverage, in the shown embodiment only approximately half the value. According to the equation "force=load×effective leverage" a force compensation is achieved in this manner. Upon pivoting the adjusting lever 53, the piston rod 45 of the gas spring 44 is pushed into its housing and the force generated by the gas spring 44 is increased correspondingly. Since the effective leverage is however reduced in this manner, the force increase is thus effectively compensated. With a corresponding design of the adjusting element 36 and of the adjusting lever 53, the force increase can thus be completely compensated. Thus, the counterforce generated by the gas spring 44 upon displacement of the table top 1 in the downward direction does not take effect. The user can thus displace, respectively, lower the table top 1 without exerting great forces. However, a reliable weight compensation is still ensured.

When a great weight is to be compensated, the counterforce of the weight-compensating device must be correspondingly high so that the release of the table top 1 does not cause it to suddenly drop. In this case, the adjusting shaft 41*a* is turned with the grip 65 such that the piston rod 45 of the gas spring 44 is pushed into the housing 47. The farther the piston rod 45 is retracted from the housing, the smaller the counterforce of the gas spring 44 will be. With the adjusting shaft 41*a* this counterforce can be adjusted continuously so that the user can easily and quickly adjust the required counterforce, depending on the weight forces of the table top or work top 1. When a high counter force is required, the adjusting shaft 41*a* is rotated with the grip 65. In turn, the threaded spindle 60 is rotated by via the bevel gear system 63, 64 to such an extent that the transverse bolt 56 is upwardly displaced within the slotted holes 54, 55. In FIG. 2 the transverse bolt 56 is positioned at the upper end of the slotted holes 54, 55, i.e., the greatest amount of weight can be compensated. When a low weight is to be compensated, the transverse bolt 56 is displaced downwardly within the slotted holes 54, 55 and the piston rod 45 of the gas spring 44 is correspondingly pushed into the housing. Thus, in any case it is ensured that during height adjustment of the table top 1 no great forces are required by the user. When the table top 1, respectively, the things placed thereon have a great weight, it is not required to exert a great force in order to displace the table top 1 from a higher to a lower position. It is however ensured with the described embodiment of the weight- and force-compensating devices that the table top 1 cannot suddenly drop, but that at any level the table top 1 is securely held by the weight-compensating device. The operator thus can without effort adjust the height of the table top 1 as desired. The parallel guide system of the supports 2, 3 in the form of the pulling cables 12, 20 ensures that these supports 2, 3 can be synchronously adjusted in their height and a jamming within the columns 4, 5 does not occur. The gas spring 44 can be of a short design due to the intermediate placement of the adjusting element 36 between the set of pulleys 26 and the gas spring 44 so that the disclosed weight-compensating device is especially suitable for such tables that have a relatively short width. However, the table top 1 can still be loaded with great weight because the weight-compensating device ensures that even great forces can be securely compensated.

In order to be able to arrest the table top 1 at the selected level relative to the table frame, an arresting device 68 (FIGS. 5 and 6) is provided at least in one of the columns 4. Such arresting devices are known in general from German Patent 32 39 357 and will thus be explained only briefly in the following. In column 4 a push/pull rod 69 is provided that extends in the longitudinal direction of the column 4 and which has connected thereto for adjacently positioned locking disks 70. They are provided alternatingly with a toothing 71 at a side extending in the direction of height which cooperates with a counter toothing 72 at the support 2 (FIG. 6). In the arrested position the locking disks 70 are secured by a tension spring 73 engaging the push/pull rod 69. Thus, the support 2 cannot be displaced relative to the column 4.

At the lower end the push/pull rod 69 rests on support member in the form of a pin 74 (FIG. 5) which extends downwardly into the stay 6. Within the stay 6 a two-arm lever 75 is pivotably supported at one end of which the pin 74 is supported so as to be pivotable to a limited extent. At the end of the lever 75 that is facing the user, an actuating device in the form of an actuating member 76 is provided that projects upwardly past the stay 6 and can be easily pressed down by the user with his foot. When the lever 75 is pivoted in a clockwise direction about the axis 77 (FIG. 5), the push/pull rod 69 is upwardly moved against the force of the tension spring 73 via the action of the pin 74. This causes a locking bolt 78 which penetrates the locking disks 70 to glide into curved openings 79 of the locking disks 70. The openings 79 in neighboring locking disks 70 are, as shown in FIG. 6, curved in opposite directions such that upon upward displacement of the push/pull rod 69 the locking bolt 78 retracts the locking disks 70 so that their toothings 71 disengage the counter toothings 72. The support 2 is thus released and can now be displaced in the desired direction. Via the aforedescribed weight-compensating device it is ensured that the support 2 cannot suddenly drop when released, but is secured in its position by the weight-compensating device. As long as the operator suppresses the actuating member 76 with his foot, the locking disks 70 remain disengaged from the counter toothing 72. As soon as the table top 1 has been adjusted at the desired height, the actuating member 76 is released. Under the force of the spring 73 the push/pull rod 69 is again downwardly displaced so that the lever 75 is rotated counterclockwise about the axis 77. The locking bolt 78 pushes the locking disks 70 outwardly so that their toothings 71 engage the counter toothings 72 of the support 2.

In order to be able to activate the arresting device 68 from any desired position at the work table, it is possible to pivot the lever 75 with a further actuating device 80. This further actuating device 80 can be provided in addition to the actuating member 76 or as the only actuating device of the work table. Its embodiment will be explained in detail with the aid of FIGS. 3, 5 and 6.

Figure 5:
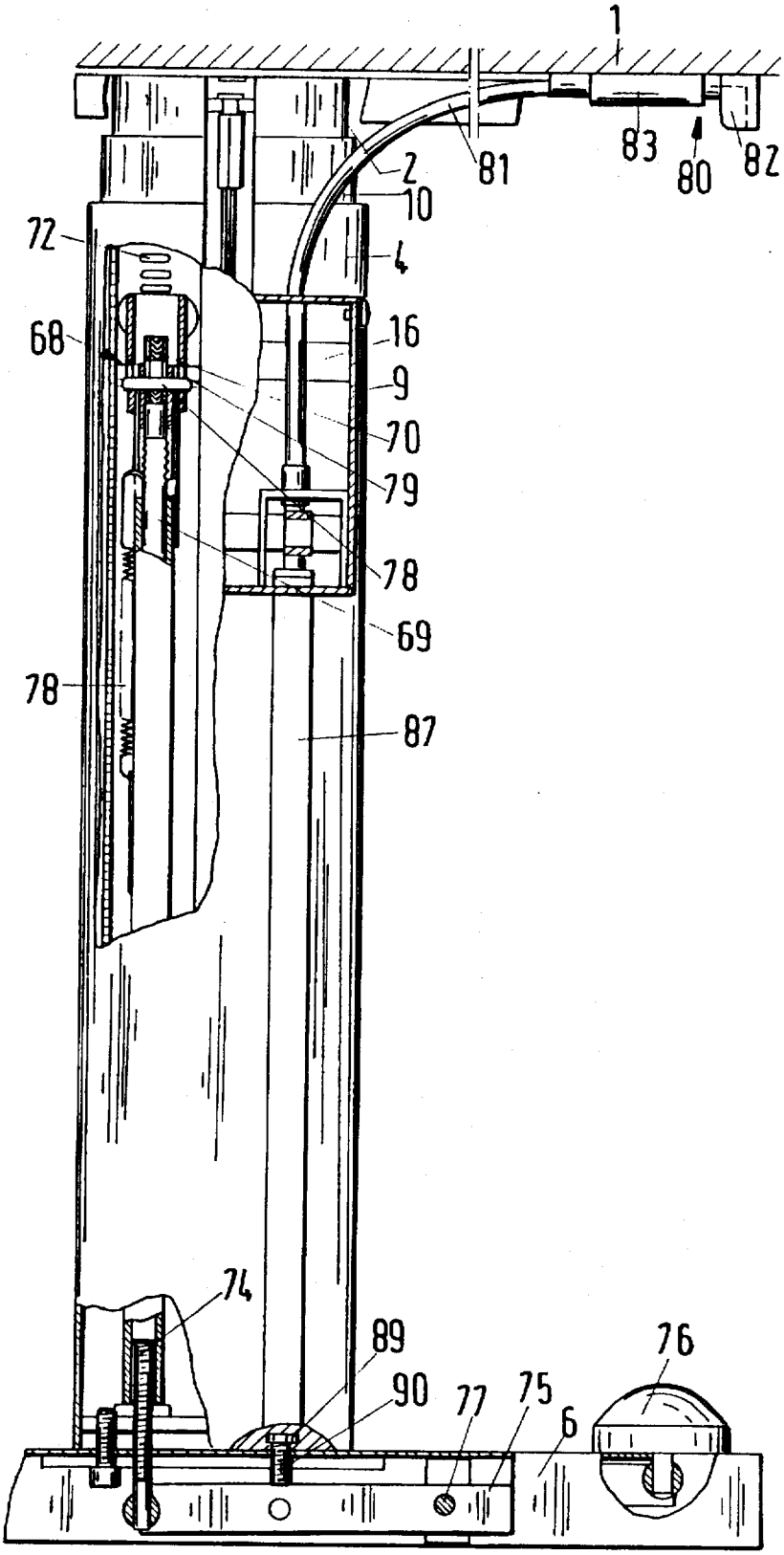
FIG. 5 shows partly in section and partly in an elevated view one of the arresting devices positioned in one of the supports of the work table of FIG. 1.
Figure 6:
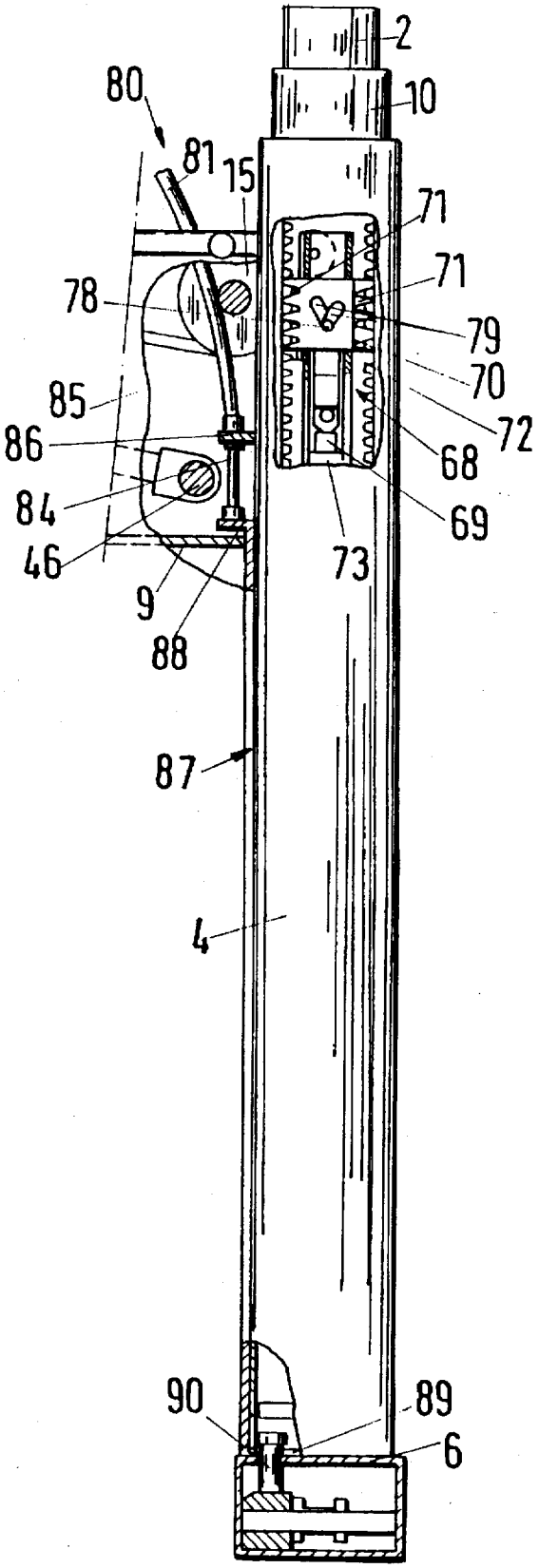
FIG. 6 shows partly in section and partly in an elevated view the support of FIG. 5.

The actuating device 80 comprises a Bowden pull 81 which according to FIG. 5 is guided to the edge of the table top 1 facing the user of the work table. The Bowden pull 81 is provided with a handle that is for example in the form of a pivotable grip 82 (FIG. 3). This grip 82 is fastened within a holder 83 that is connected to the underside of the table top 1 and is pivotable in the holder 83. The grip 82 is connected to the cable 84 of the Bowden pull 81. By pivoting the handle 82 relative to the holder 83 the cable 84 is displaced within the guide sleeve 85 of the Bowden pull 81. The holder 83 can be connected at any desired location to the table top 1 so that the actuating device 80 can be easily activated by the user.

The Bowden pull 81 extends through an opening into the transverse beam 9 (FIGS. 5 and 6). A tongue 86 is connected to the column 4 and extends into the transverse beam 9. The end of the guide sleeve 85 is connected to this tongue 86. Within the transverse beam 9 the cable 84 is connected to a slide 87 that extends downwardly from the transverse beam 9 to the stay 6 and is positioned directly adjacent to the column 4. The upper and the lower end 88, 89 of the slide 87 are bent at a right angle and are forked. The cable 84 of the Bowden pull 81 is connected to the upper end 88 which is positioned within the transverse beam 9. A bolt 90 that is pivotably connected to the lever 75 is connected to the end 89. The end 89 is bent in the opposite direction relative to the end 88. The head of the bolt 90 is engaged by the legs of the end 89 of the slide. The bolt 90 is connected to the lever 75 in the area between the pin 74 and the pivot axis 77 (FIG. 5). The bolt 90 extends upwardly past the stay 6 so that the forked end 89 of the slide 87 can easily engage the bolt 90.

When it is desired to adjust the height of the table top 1, the grip 82 is actuated, respectively, pivoted so that via the cable 84 of the Bowden pull 81 the slide 87 is upwardly displaced. Via the bolt 90 the lever 75 is pivoted clockwise about the axis 77 so that in the manner described above the locking disks 70 disengage the counter toothings 72. Subsequently, the table top 1 can be adjusted in its height in the aforementioned manner. When the grip 82 is released, the Bowden pull is returned into its initial position so that the slide 87 is displaced downwardly. The lever 75 is pivoted counterclockwise about the axis 77, and the locking disks 70 with their toothings 71 again engage the counter toothings 72 of the support 2.

Figure 7:
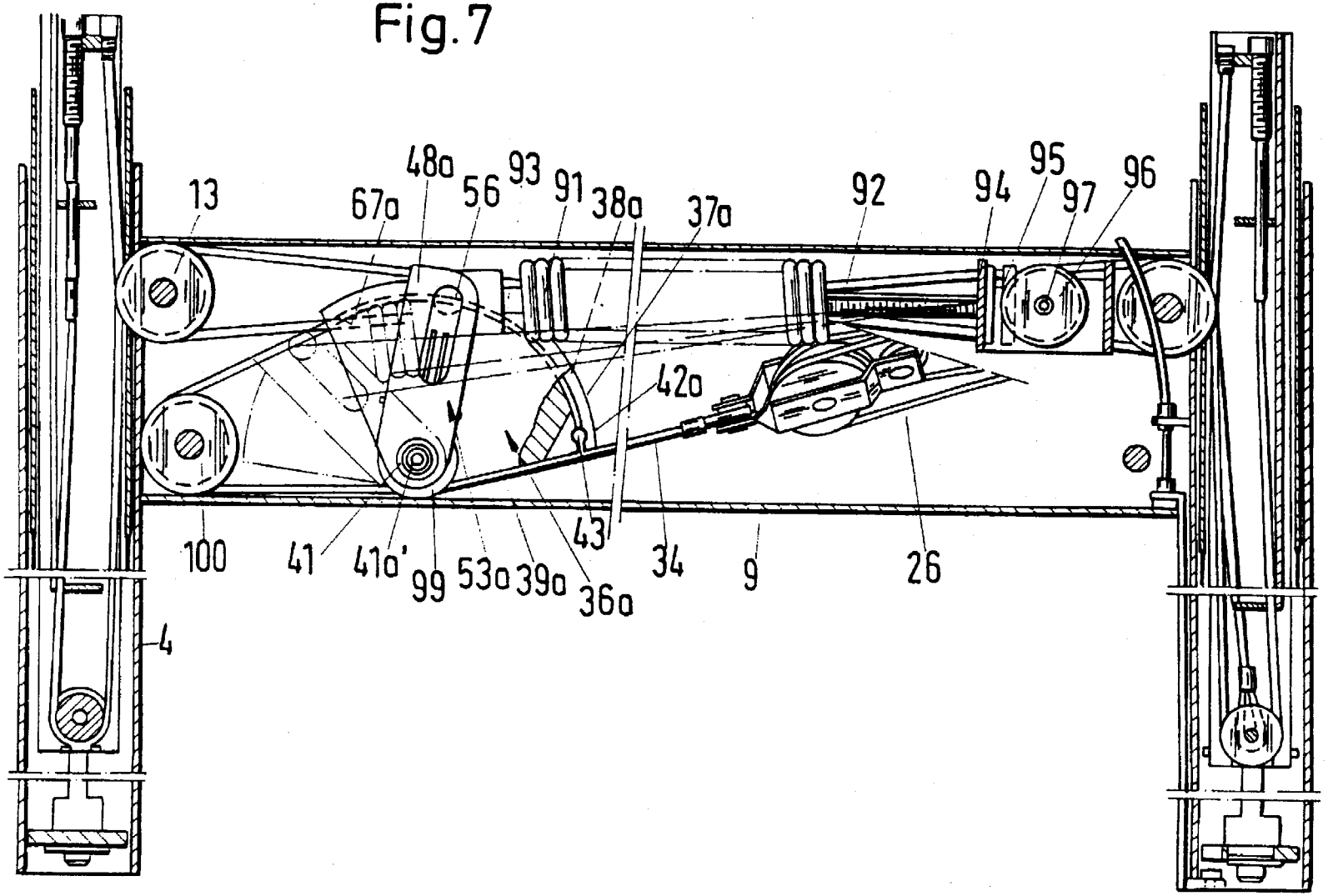
FIGS. 7–9 show in representations corresponding to FIGS. 2–4 a second embodiment of a further inventive work table.
Figure 8:
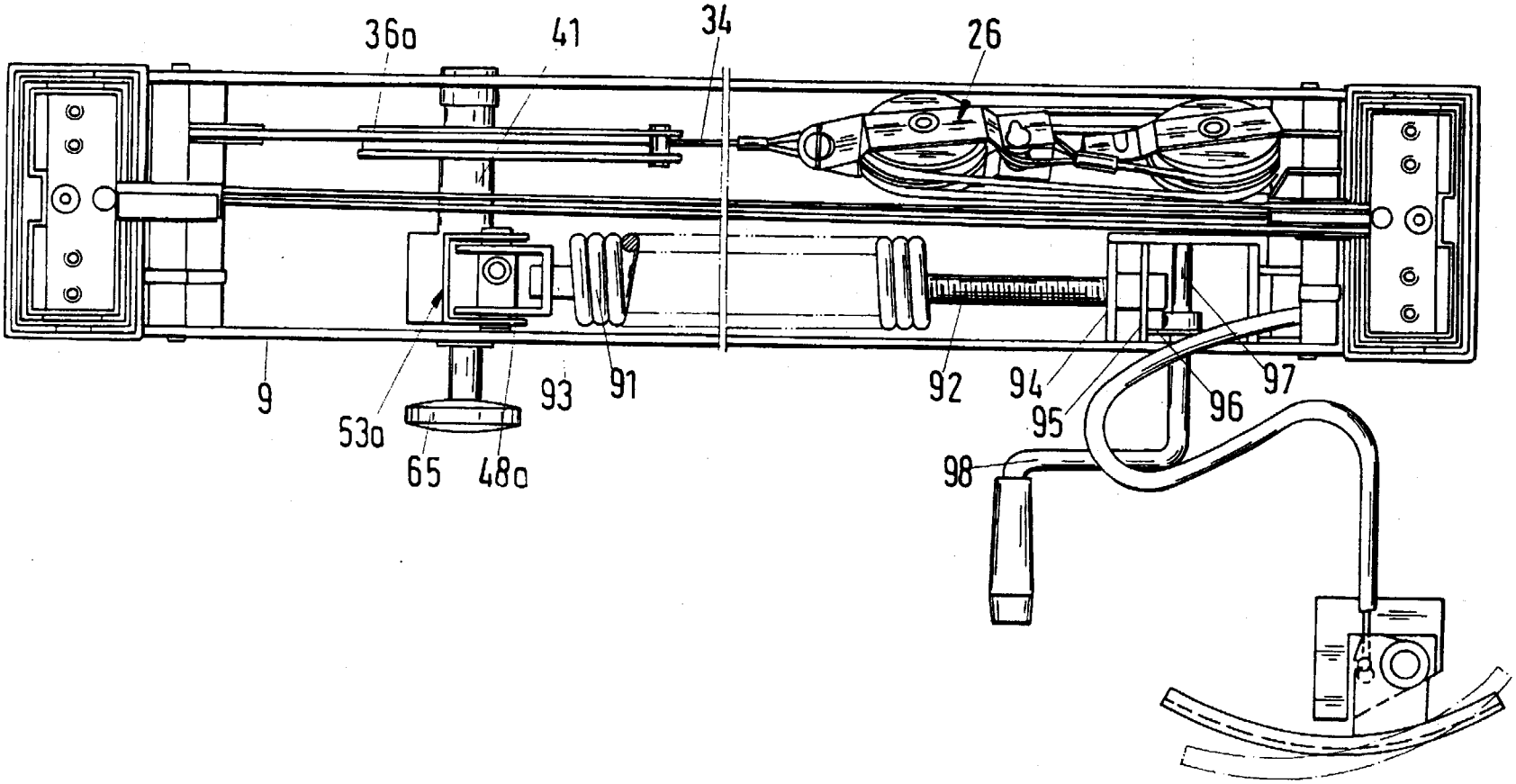
Figure 9:
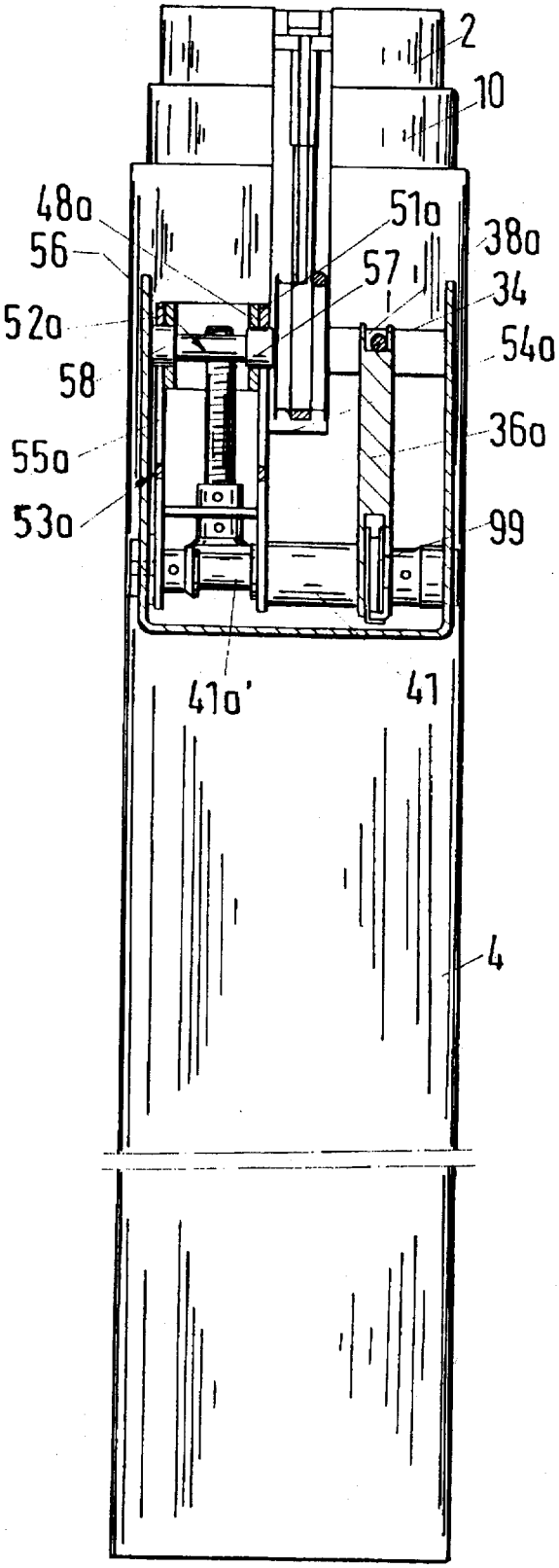

FIGS. 7 to 9 show an embodiment in which the weight compensating device has a force reservoir not in the form of a gas spring, but in the form of a tension spring 91. A threaded spindle 92 is provided and extends in the longitudinal direction of the transverse beam 9 along the same axis as the tension spring 91. The threaded spindle 92 is connected in a non-represented manner with a non-represented threaded nut to the tension spring 91. The other end of the tension spring 91 is connected via a connecting part 93 to the bracket **48*a* that is connected to the transverse bolt 56. With its thickened end portions 57, 58 (FIG. 9) the transverse bolt 56 is supported in the slotted holes 54*a*, 55*a* of the adjusting lever 53*a*. As described in connection with the previous embodiment, the adjusting lever 53*a* is U-shaped and has two legs 51*a*, 52*a* in which slotted holes 54*a*, 55*a* are provided. The threaded spindle 92 is rotatably supported in a holder 94 provided at the inner side of the transverse beam 9 which holder 94 is in the shape of a housing. A gear wheel 95 is fixedly connected within the holder 94 to the threaded spindle 92 and meshes with a gear wheel 96 that is fixedly connected to a drive shaft 97. The threaded spindle 92 can be turned with a crank 98 (FIG. 8) in order to adjust the tension of the tension spring 91** in a continuous manner.

The set of pulleys 26 which is embodied in the same manner as described in connection with the previous embodiment, is connected with the tensioning cable 34 to the adjusting element **36*a*. A guide pulley 99 (FIG. 7) is seated freely rotatable on the shaft 41 and has a diameter such that the tensioning cable 34 can be deflected from the bottom about the guide pulley 99 to a further guide pulley 100 without coming into contact with the adjusting element 36*a* (solid lines in FIG. 7) even when it is rotated to the maximum extent. The guide pulley 100 is freely rotatable and located in the area below the guide pulley 13 within the transverse beam 9. However, it does not project into the column 4, but the guide pulley 13 does. The guide pulley 100 is positioned at a distance from the adjusting element 36*a* and deflects the tensioning cable 34 toward the adjusting element 36*a*. It is provided with a curved mantle surface 37*a* shaped according to a portion of a circular arc. The groove 38*a* for receiving a part of the tensioning cable 34 is provided at this mantle surface 37*a*. The tensioning cable 34 is connected with a catch element 43 to the catch opening 42*a* in the planar end face 39*a* of the adjusting element 36*a*. In comparison to the aforedescribed embodiment, the adjusting element 36*a* is designed such and arranged such that the opening 42*a* now faces the set of pulleys 26**.

Otherwise, this embodiment is identical to the embodiment of FIGS. 1 to 6. In order to adjust the weight-compensating device to the different weights of the table top 1, respectively, of the things placed thereon, the transverse bolt 56 can be turned with the grip 65, in the manner disclosed in connection with FIGS. 1 to 6, within the slotted holes **54*a*, 55*a* of the lever 53*a*. Correspondingly, the tension spring 91 is expanded to a greater or lesser extent. Upon displacing downwardly the table top 1, the lever 53*a* and the adjusting element 36*a*, which are both fixedly connected to the shaft 41, are pivoted counterclockwise with the aid of the tensioning cable 34 in FIG. 7. This reduces the effective leverage of the lever 53*a* in the disclosed manner while, the counterforce generated by the tension spring 91 is increased. This counterforce is compensated due to the reduced effective leverage of the force-compensating device so that the user, despite the increasing counterforce of the tension spring 91, can lower the table top 1 with only minimal forces. Preferably, the counterforce is completely compensated. With the adjusting shaft 41*a* on which the shaft 41** is supported the corresponding optimal counterforce can be easily set by the user.

This inventive embodiment also ensures that the tension spring 91 can be short even when a great counterforce must be generated. Due to the intermediate placement of the adjusting element 36*a* and the lever 53*a* between the set of pulleys 26 and the tension spring 91, it is ensured that the force increase generated by tensioning the tension spring 91 can be at least approximately compensated by the change in effective leverage. Thus, it is ensured in this embodiment that the table top 1 can be displaced easily downwardly, even when having a great weight, upon releasing the arresting device of the support 2 in the manner disclosed in context with the first embodiment. The tension spring 91, since it has only a short length, can also be positioned within the transverse beam 9 even if this transverse beam 9 is of a short length.

Figure 10:
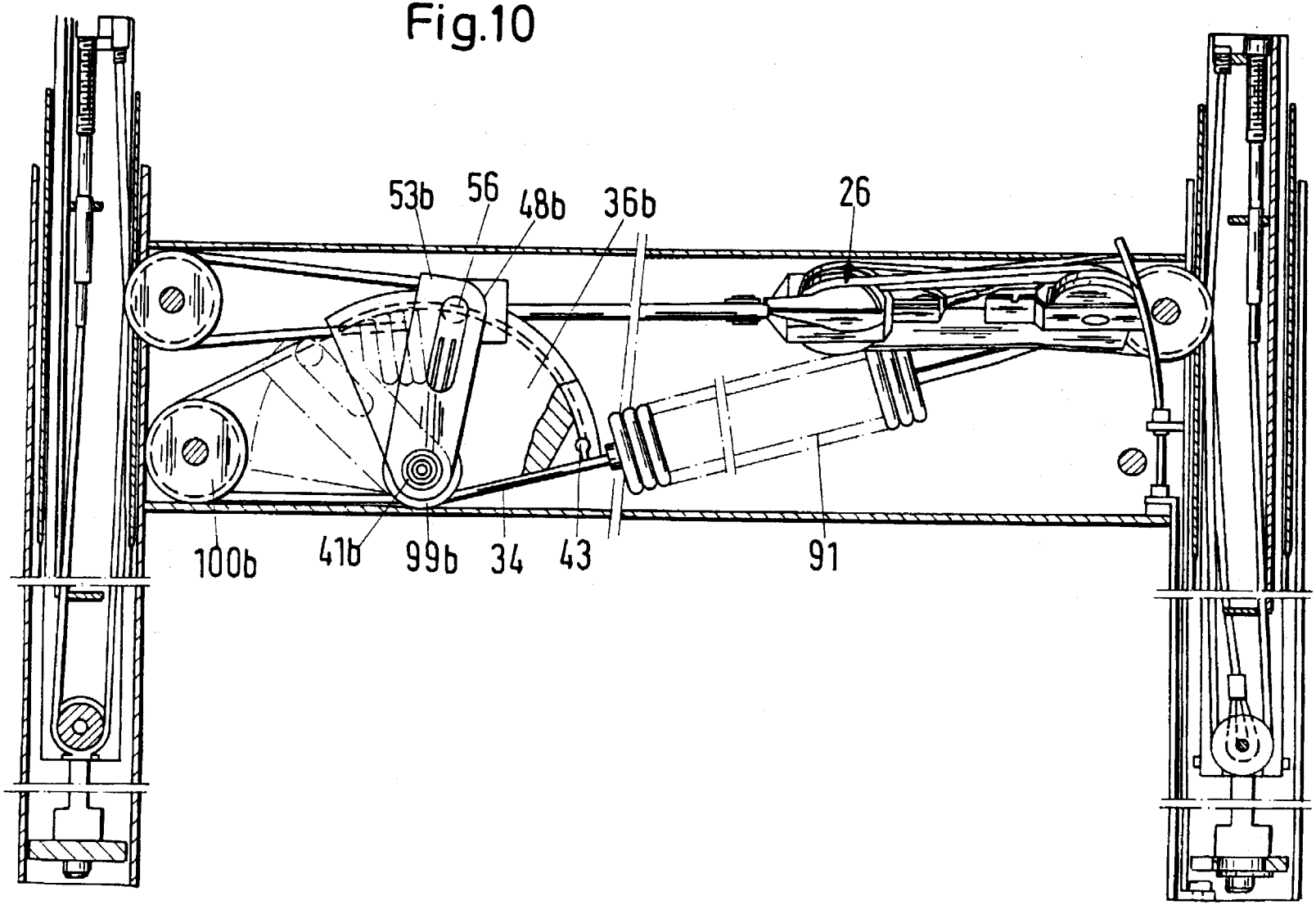
FIG. 10.
Figure 11:
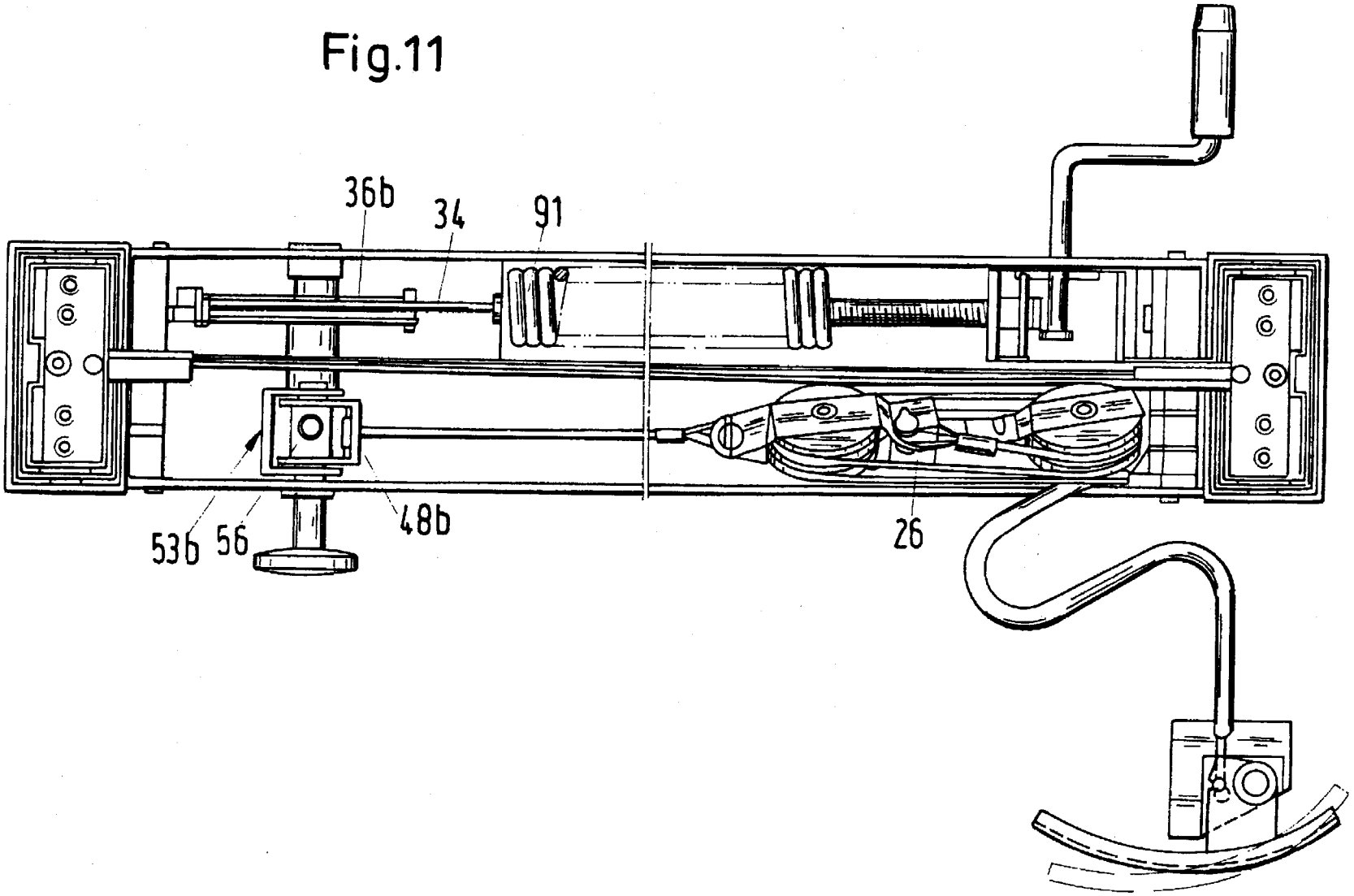
FIG. 11 show in representations corresponding to FIGS. 2 and 3 a third embodiment of an inventive work table.

In the embodiment according to FIGS. 10 and 11 the position of the set of pulleys 26 and of the force reservoir 91 is changed in comparison to the previously described embodiments. However, the function of this work table is not changed by these structural changes. The set of pulleys 26 is now connected via the bracket 48*b* with the lever 53*b* and the transverse bolt 56. The tension spring 91 is connected with one end to a non-represented holder in FIGS. 10 and 11, while the other end is connected in a non-represented manner to the tensioning cable 34. The tensioning cable 34 is guided about guide pulleys 99*b*, 100*b* to the adjusting element 36*b* to which it is connected in the aforedescribed manner with a catch element 43. By turning the adjusting shaft 41*b*, the transverse bolt 56 is displaced in the slotted holes of the adjusting lever 53*b* in the respective directions in order to ensure the required weight compensation. In this embodiment the increase of the force characteristic line of the tension spring 91 is compensated due to the described embodiment of the adjusting elements 36*b* and of the adjusting lever 53*b* so that even for a great counterforce the table top 1 can be displaced downwardly without requiring great forces. The spring 91 can again be of a short construction, even when a high counterforce must be provided.

In all of the aforedescribed embodiments the adjusting element (36) together with the adjusting lever (53) can also be arranged so as to be suspended, i.e. the shaft 41 can be located in the vicinity of the upper side of the transverse beam 9. In this case the tensioning cable 34 is guided and connected correspondingly to the adjusting element. The guide pulleys 13, 15 in this construction are positioned in the area below the adjusting element. The arresting device 68 can be provided in both columns 4 and 5. It is also possible to design work tables such that more than two columns are provided. In this case, each of the columns may be provided with an arresting device. The actuating part 76 for the arresting device 68 can be positioned, as desired, at the right or left stays 6 or 7, or, if a plurality of columns are provided, at any of the suitable stays. The slide 87 cannot only be provided at the outer side of the column facing the opposite column, as shown in FIGS. 5 and 6, but can also be provided at the forward facing side of each column 4, 5 that is facing the user of the work table. Since the slide 87 is provided exterior to the columns, the slide can be easily mounted and other work tables can be retrofitted. It is also possible to position the slide 87 within the respective support so that it is not visible from the exterior.

Figure 13:
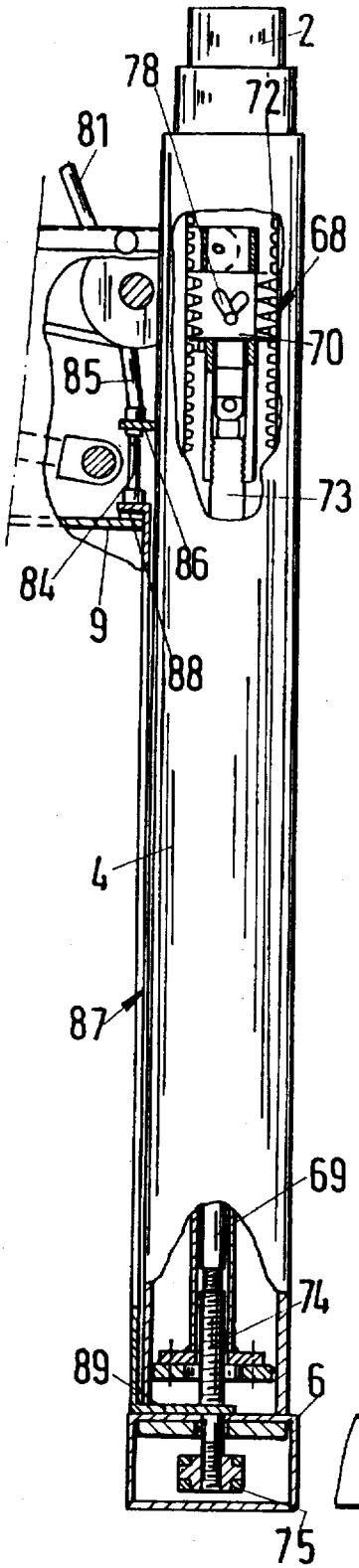
FIG. 13 show in representations corresponding to FIGS. 5 and 6 a further embodiment of the inventive work table.
Figure 12:
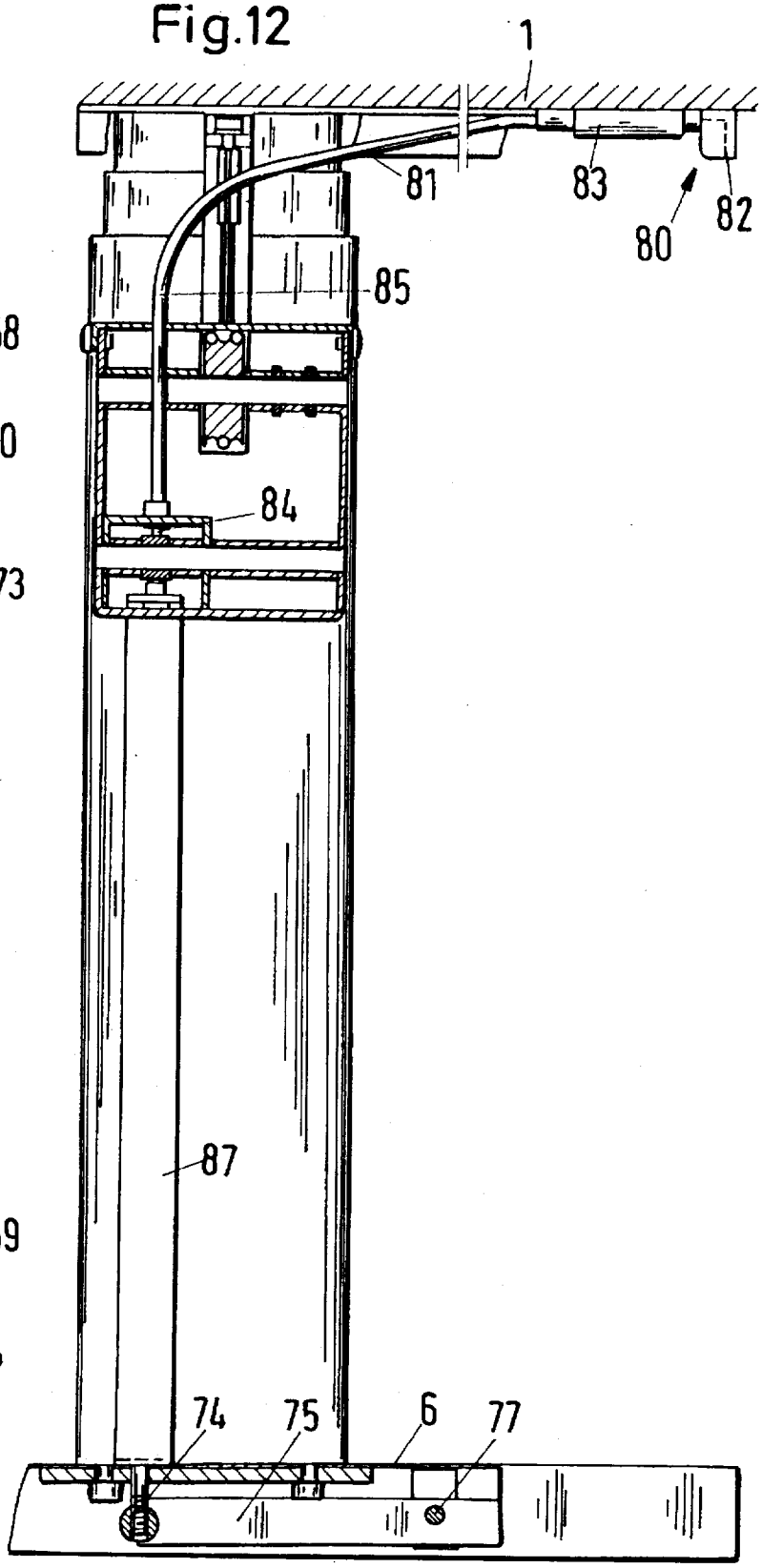
FIG. 12.

In the embodiment according to FIGS. 12 and 13 the arresting device 68 is exclusively actuated by actuating device 80. This actuating device 80 comprises a Bowden pull 81 which is connected to a handle 82 located close to the edge of the table top 1 facing the user. By actuating the grip of the handle 82 the cable 84 is displaced within the guide sleeve 85 of the Bowden pull. The holder 83 for the actuating device 80 can, as disclosed in connection with the embodiments of FIGS. 5 and 6 be positioned at a suitable location on the table top 1 so that the actuating device 80 is easily accessible by the user.

The Bowden pull 81 projects through an opening in the transverse beam 9. The tongue 86 is connected to a column 4 and extends into the transverse beam 9. At the end of the tongue 86 the guide sleeve 85 is connected. Within the transverse beam 9 the cable 84 is connected to the slide 87 which projects downwardly from the transverse beam 9 and extends directly adjacent to the column 4 to the stay 6. The upper and the lower ends 88, 89 of the slide 87 are bent at a right angle and are forked. The cable 84 of the Bowden pull 81 is engaged by the upper end 88 positioned within the transverse beam 9. The lower end 88 which is bent in the opposite direction to the upper end 88 is engaged by the pin 74 which is supported so as to be pivotable to a limited extent to the free end of the lever 75. The push/pull rod 69 rests, in the manner disclosed in connection with the previous embodiments, on the pin 74. The lever 75, in contrast to the embodiment of FIGS. 5 and 6, is a one-arm lever. The actuating member 76 (FIGS. 5 and 6) is not needed.

When it is desired to displace the table top 1 with respect to its height, the grip 82 is actuated so that via the cable 84 of the Bowden pull 81 the slide 87 is upwardly displaced. This results in the displacement of the angular end 89 of the slide 87 in the upward direction by the pin 74 whereby the lever 75 is pivoted about its axis 77. Via the pin 74 the push/pull rod 69 is also upwardly displaced counter to the force of the tension spring 73 so that, in the manner disclosed above, the locking disks 70 are retracted and disengaged from the counter toothing 72. The support 2 is thus released and can be displaced in the desired direction. With the weight-compensating device it is ensured that the support 2 upon release cannot drop suddenly, but is maintained in its respective position by the weight-compensating device. As long as the user actuates the grip 82, the locking disks 70 remain disengaged from the counter toothings 72. As soon as the table top 1 has been displaced to the desired height, the grip 82 is released. The force of the spring 73 returns the push/pull rod 69 so that the lever 75 is pivoted about the axis 70 counterclockwise. As disclosed above, the locking disks 77 are pushed by the transverse bolt 78 outwardly so that they engage the counter toothing 72 of the support 2. The slide 87 is also returned into its initial position, represented in FIGS. 12 and 13, by the pin 74.

This embodiment is characterized by a simple constructive design. Since the Bowden pull 81 is flexible, it can be placed anywhere on the work table so that the grip 82 is located at the desired location. It is also possible to provide two or more Bowden pulls with which the slide 87 can be actuated. The various Bowden pulls are provided with corresponding grips 82 which can be located at different places at the work table. Thus, the user is able to adjust the height of the table top from various locations.

Figure 14:
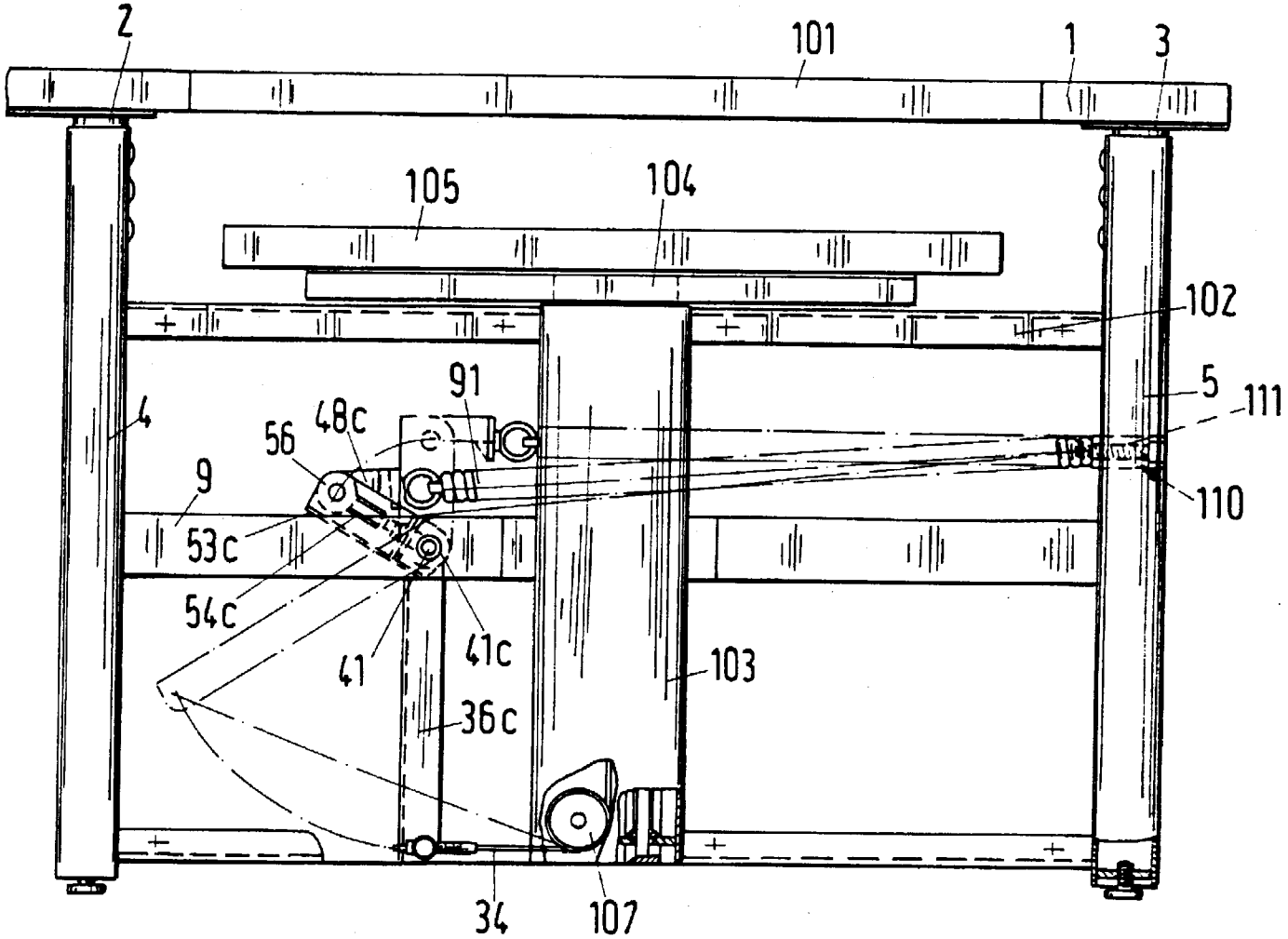
FIG. 14 shows a side view, partially in section, of a further embodiment of an inventive work table.
Figure 15:
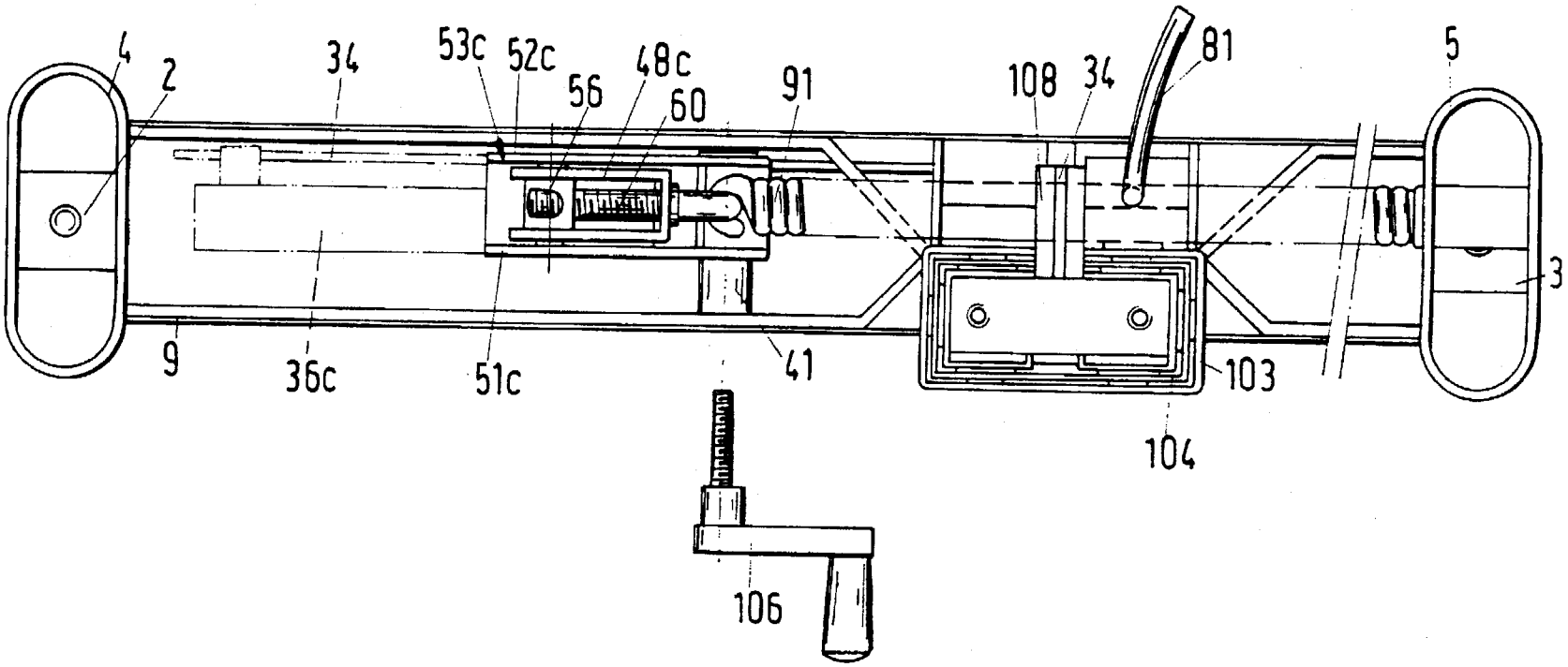
FIG. 15 shows partly in an elevated top view and partly in section the work table of FIG. 14.

FIGS. 14 to 17 show a work table with columns 4 and 5 which receive supports 2 and 3 that support the table top 1. The table top 1 has an opening 101 that can have any desired contour. The two columns 4, 5 are connected to one another by two transverse beams 9 and 102. In the area between the columns 4, 5 a further column 103 is provided in which at least one support 104 is telescopically displaceable. The support 104 supports a further table top 105 the contour of which matches the opening 101 of the table top 1. In FIG. 14 the table top 105 is shown in its lowermost position. By extending the support 104, the table top 105 can be upwardly displaced through the opening 101 of the table 1. When the plate 105 as well as the opening 101 have the same contour, a continuous work surface results when the table top 105 is at the same level as the opening 101. However, it is not required to match the contour of the table top 105 to the contour of the opening 101. The table top 105 can also have any other contour not matching the one of the opening 101.

The column 104 is arrested in the manner disclosed above (FIGS. 5 and 6) with the adjacently positioned locking disks 70 (FIG. 17) the toothings 71 of which engage the counter toothings 72 of the support 104. The locking disks 70 are secured in their position by the tension spring 73 engaging the push/pull rod 69. The push/pull rod 69 rests on the pin 74 which is connected to the lower end 89 of the slide 87. The slide 87 extends into the transverse beam 9 in which the upper bent end 88 of the slide 87 is positioned. As shown in connection with FIGS. 5, 6 as well as FIGS. 12, 13, this upper bent end 88 of the slide 87 is connected to the cable 84 of the Bowden pull 81 which can be actuated by the grip 82. The Bowden pull 81 with grip 82 is part of the actuating device 80 with which the arresting device can be released in the disclosed manner for height adjustment of the table top 105. When the grip 82 is actuated, the Bowden pull 81 displaces upwardly the slide 87 so that in the corresponding manner the pin 74 is also lifted. The pin 74 moves the push/pull rod 69 upwardly counter to the force of the tension spring 73 so that the locking disks 70 are retracted in the manner disclosed above and disengaged from the toothings of the support 104. The table top 105 can thus be displaced by the desired amount with respect to its height. When the grip 82 is released, the push/pull rod 69 is downwardly displaced by the force of the spring 73 so that the pin 74 and the slide 87 are returned into the initial positions shown in FIGS. 16 and 17. The locking disks 70 are moved outwardly by the locking bolt 78, as described above, so that they again engage the counter toothings 72 of the support 104 in order to arrest the support 104 relative to the column 103.

In order to prevent that after release of the arresting device the table top 105 together with the support 104 drops suddenly, a weight-compensating device is also provided in this embodiment. The weight-compensating device has a force reservoir in the form of a tension spring 91 which with one end is connected to the column 5 and with the other end to the bracket **48*c*. The bracket 48*c* rests on the transverse bolt 56 the ends of which are supported in slotted holes 54*c* (FIG. 14) of the U-shaped adjusting lever 53*c*. The adjusting lever 53*c* comprises two legs 51*c*, 52*c* (FIG. 15**) in which these slotted holes are provided.

The adjusting lever **53*c* is fixedly connected to the shaft 41 which is supported rotatably on the adjusting shaft 41*c*. The adjusting shaft 41*c* can be turned with a crank 106 (FIG. 15) about its axis. The adjusting shaft 41*c* is, in correspondence to the embodiment of FIG. 1 to 4, connected via a gear wheel system to the threaded spindle 60 on which the transverse bolt 56 is seated. As disclosed in detail in connection with FIGS. 1 to 6, by rotating the crank 106 the transverse bolt 56 can be displaced along the threaded spindle 60. This also results in a displacement of the position of the bracket 48*c* relative to the adjusting lever 53*c*. With this displacement the counterforce generated by the spring 91 can be adjusted to the weight of the table top 105** in a continuous manner, as described above.

The adjusting element **36*c* is also fixedly connected to the shaft 41 which adjusting element 36 in this embodiment is in the form of a one-arm lever. In a side view according to FIG. 14, the adjusting lever 53*c* and the adjusting element 36*c* are positioned at an obtuse angle relative to one another. To the free end of the adjusting element 36*c* facing away from the adjusting shaft 41*c* one end of the tensioning cable 34 is connected. It is deflected by being guided about a guide pulley 107 which is positioned at the lower end within the column 103. The axle of the guide pulley 107 is positioned parallel to the axis of the adjusting shaft 41*c*. The tensioning cable 34 is guided from the bottom over the guide pulley 107 into the column 103**.

Figures 16, 17:
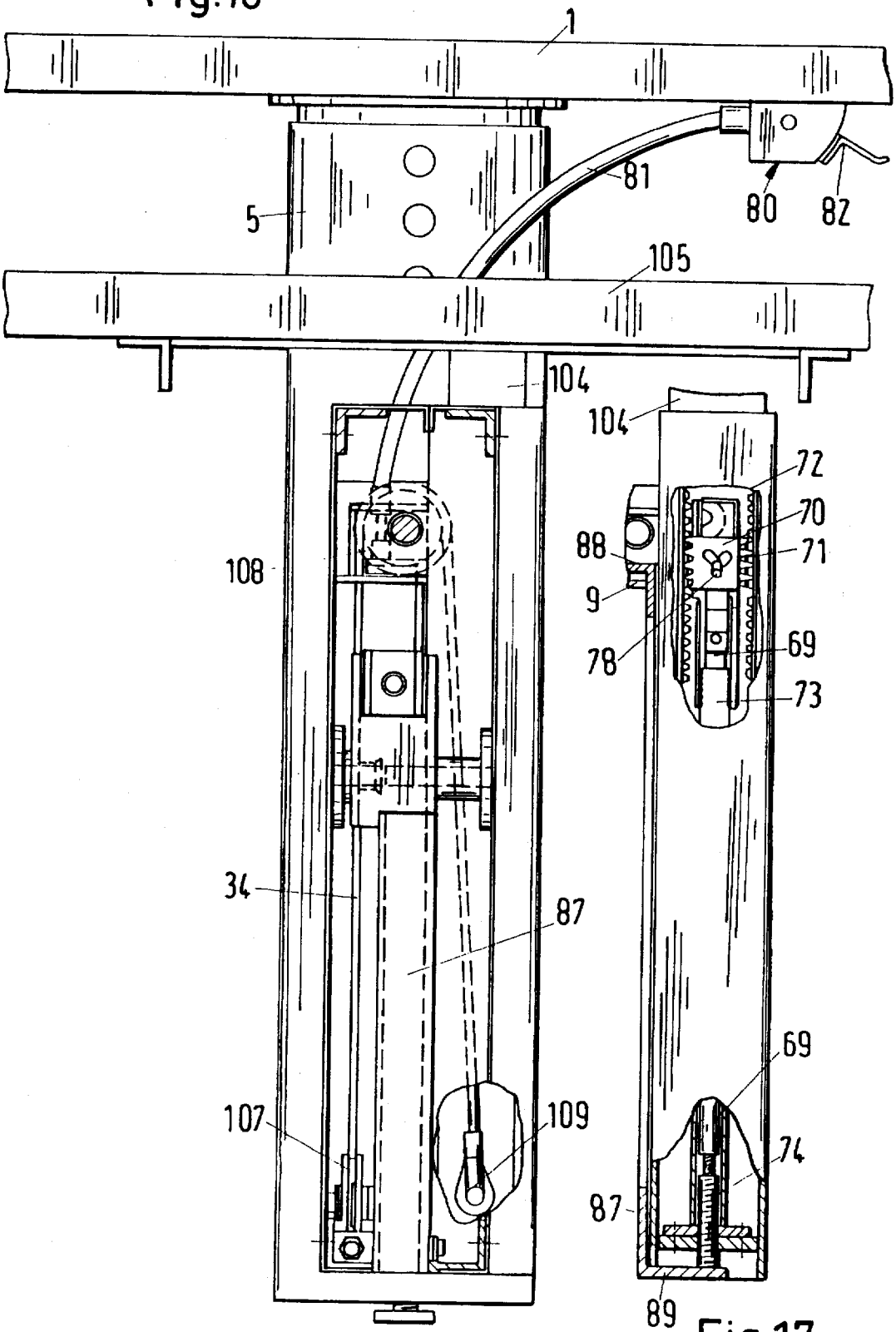
FIG. 16 shows in a longitudinal section a height-adjustable column of the work table of FIG. 14.
FIG. 17 shows a further longitudinal section of the column of FIG. 16.

The tensioning cable 34 extends within the column 103 upwardly to a further guide pulley 108 (FIG. 16). Its axis of rotation is perpendicular to the rotational axis of the lower guide pulley 107. The guide pulley 108 is stationarily connected within the column 103 and is rotatable. The tensioning cable 34 is fastened to the bolt 109 within the lower end of the support 104 (FIG. 16).

In FIG. 14 the position of the adjusting element **36*c* and of the adjusting lever 53*c* for the completely lowered table top 105 is represented in solid lines. When the table top 105 is lifted after releasing the arresting device, the bolt 109 (FIG. 16) for the tensioning cable 34 provided within the support 104 moves upwardly. This results in the adjusting lever 53 and the adjusting element 36*c* being pivoted in the clockwise direction under the force of the tension spring 91. In FIG. 14 the position of these parts after lifting the table top 105 is represented in dashed lines. In the position of the adjusting lever 53*c* represented in solid lines the effective leverage is defined as the vertical distance between the axis of the transverse bolt 56 and the horizontal plane extending through the axis of the shaft 41. When the table top 105 is lifted and the adjusting lever 53*c* is rotated clockwise about the axis of the shaft 41, this effective leverage becomes greater. Simultaneously, the force of the spring 91 is reduced. In this manner a force compensation is provided for this embodiment of a work table. When, on the other hand, the work plate 105 is lowered, the adjusting lever 53*c* is pivoted counterclockwise by the tensioning cable 34 and the tension spring 91 is expanded. The increase of the counterforce generated by the spring 91 is counteracted by the reduced effective leverage between the axis of the transverse bolt 56 and the horizontal plane extending through the axis of the shaft 41. According to the equation "force=load× effective leverage" a force compensation is thus achieved in a constructively simple manner. The user can thus lower the table top 105 without great force expenditure without the risk of compromising the weight compensation. Depending on the amount of weight to be compensated, the transverse bolt 56 can be adjusted within the slotted holes 54*c* of the adjusting lever 53*c* with the aid of the crank 106. In this manner, the tension of the tension spring 91** can be adjusted.

Advantageously, the end of the tension spring 91 facing away from the bracket **48*c* is connected to a further adjusting device 110 (FIG. 14). This arresting device 110 is provided within the column 5 and has a threaded spindle 111 on which a non-represented nut is provided which is connected to the corresponding end of the tension spring 91. The threaded spindle 111 can, for example, be turned with a crank whereby the threaded nut can be displaced continuously along the threaded spindle 111**.

The adjusting lever **53*c*, the adjusting element 36*c*, and the tension spring 91 are located outside of the column 103. In order for them not to be visible from the exterior, the area between the two columns 4 and 5 is advantageously covered by cover plates etc. that can be easily connected to the transverse beams 9 and 102**.

FIGS. 18 to 21 show a work table which has only one single column 112 as a support frame. In this column 112 the support 113 which supports the table top 1 is height adjustably supported. The support 113 can, as disclosed in connection with the previous embodiments, be arrested with locking disks in the desired position relative to the column 112.

Within the column 112 a gas spring 44 is provided. The free end of its piston rod 45 seats pivotably on the axle 46 which is arranged at the lower end of the column 112. At the opposite end the housing 47 of the gas spring 44 is connected to the U-shaped bracket 48*d*. Its two legs 49*d*, 50*d* (FIG. 19) are positioned between the legs 51*d*, 52*d* of the adjusting lever 53*d*. The two legs 51*d*, 52*d* of the adjusting lever 53*d* are provided with slotted holes 54*d* (FIG. 18) extending in the longitudinal direction of the legs 51*d*, 52*d*. The ends of the transverse bolt 56 are positioned in the slotted holes 54*d* in the manner disclosed above. The legs 49*d*, 50*d* of the bracket 48*d* are supported on the transverse bolt 56. The transverse bolt 56, as in the embodiment according to FIGS. 1 to 4, can be adjusted continuously along the slotted holes 54*d* of the adjusting lever 53*d*. This adjusting option is not represented in FIGS. 18 to 21 in order to facilitate the drawings.

Figure 18:
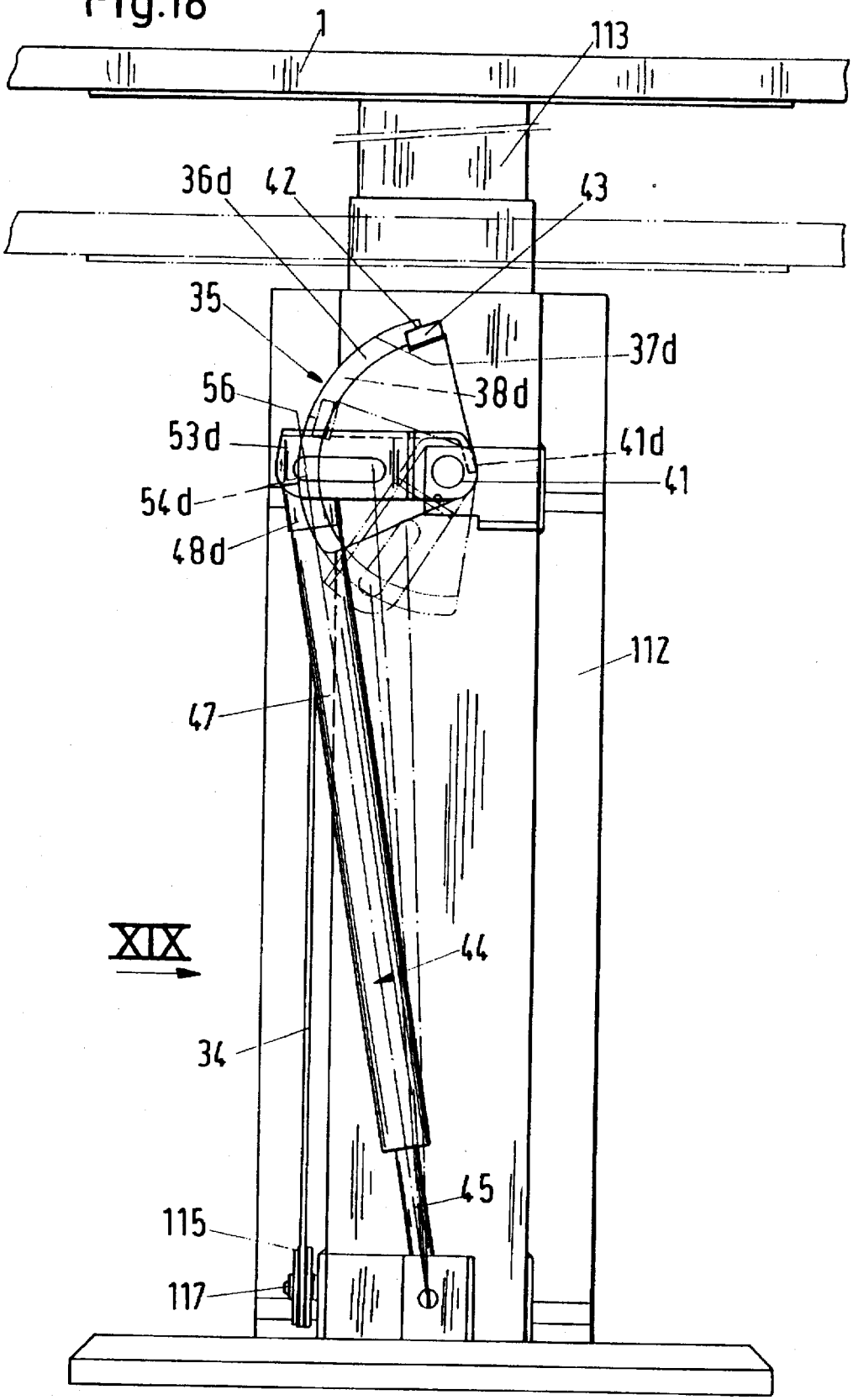
FIG. 18 shows a side view of a further embodiment of the inventive work table.
Figure 19:
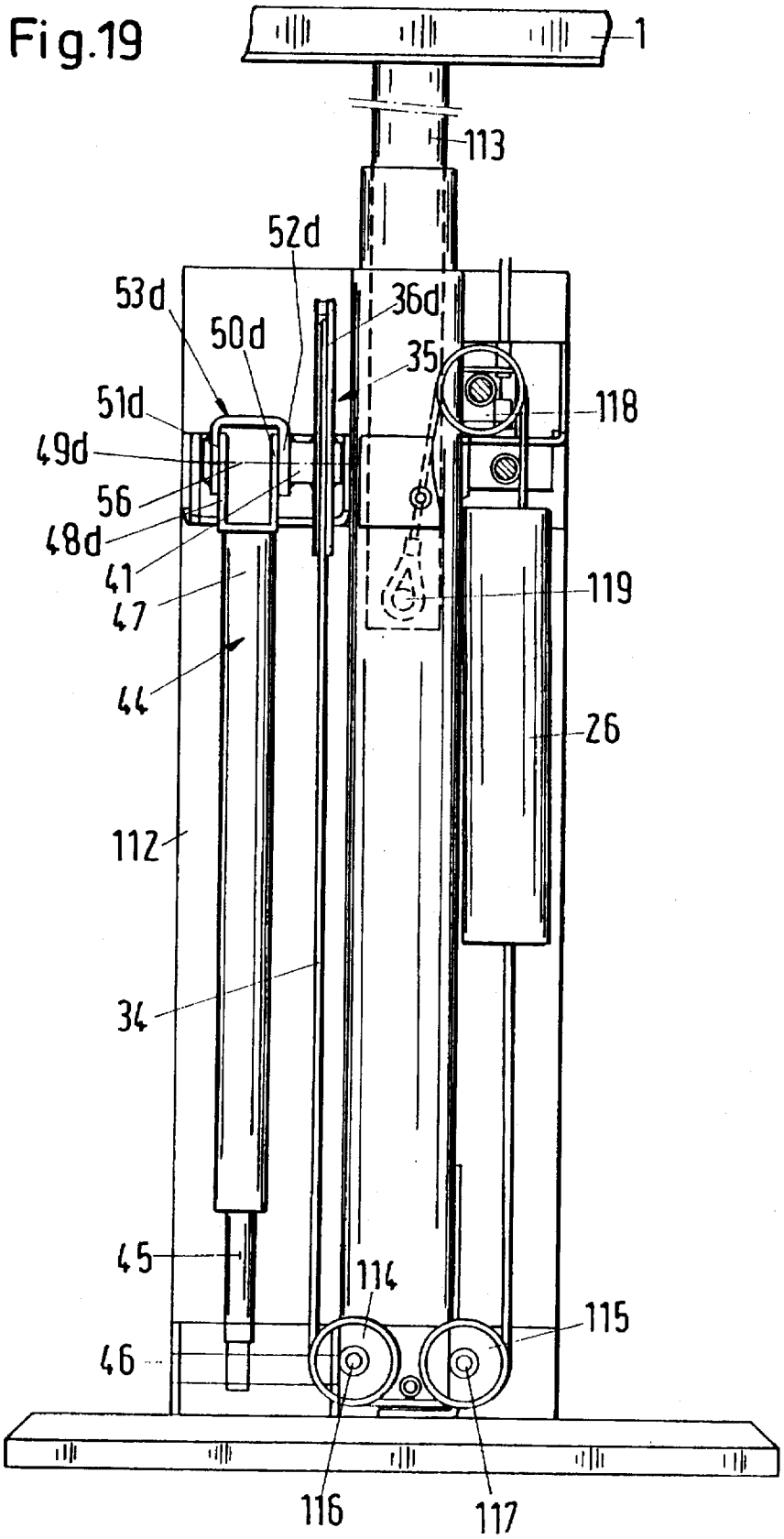
FIG. 19 shows a view in the direction of arrow XIX of FIG. 18.
Figure 21:
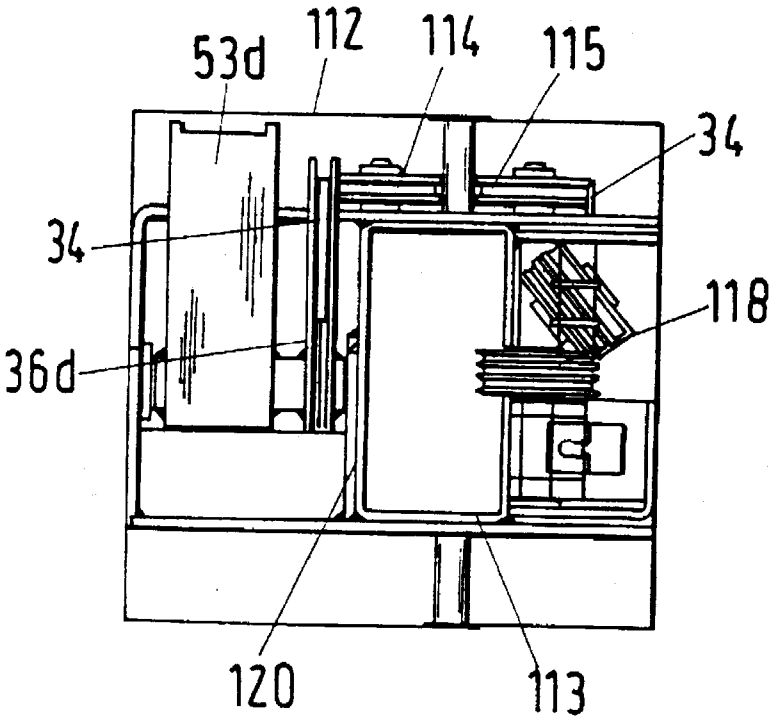
FIG. 21 shows in a representation corresponding to FIG. 20 an end view of a column of the work table of FIG. 18.
Figure 20:
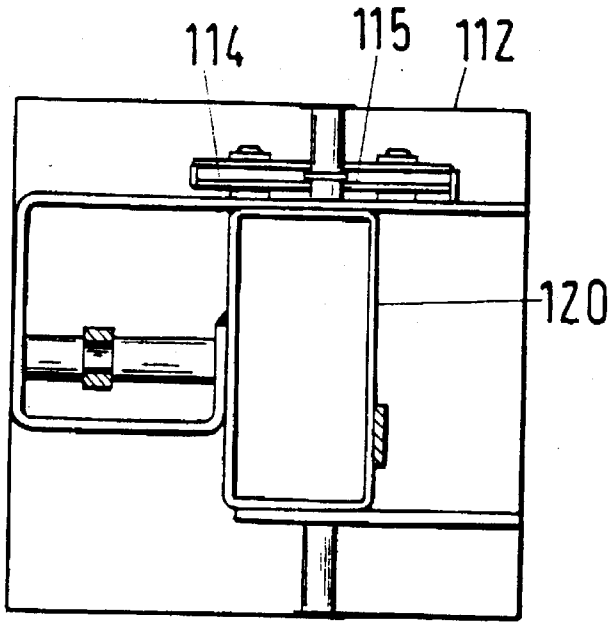
FIG. 20 shows a horizontal section of the lower end of a column of the work table according to FIG. 18.

The force compensating device 35 comprises the sector-shaped adjusting element 36*d* that has a curved mantle surface 37*d* that has a contour corresponding to the shape of part of a circular arc (FIG. 18). The mantle surface 37*d* is provided over its circumferential length with the groove 38*d*. In the groove 38*d* the tension cable 34 is positioned over a portion of its length. The adjusting element 36*d* is embodied identical to the embodiment of FIGS. 1 to 4. The adjusting element 36*d* is fixedly connected to the shaft 41 which is supported rotatably on the adjusting shaft 41*d*. The adjusting shaft 41*d* is stationarily positioned within the column 103.

The tensioning cable 34 is provided at one end with the catch element 43 with which it is inserted into the catch opening 42 of the adjusting element 36*d*. The tensioning cable 34 is guided within the column 112 downwardly to two adjacently positioned guide pulleys 114, 115 that are rotatable about two axles 116, 117 that are parallel to one another. They are positioned perpendicular to the axis of the shaft 41 as well as to the axle 46. The tensioning cable 34 is then guided within the column 112 upwardly to an upper guide pulley 118 that is positioned close to the upper end of the column 112. The schematically represented set of pulleys 26 is connected to the cable 34 between the guide pulleys 115, 118. The axis of rotation of the guide pulley 118 extends parallel to the axis 116, 117 of the lower guide pulleys 114, 115. The end of the tensioning cable 34 guided over the upper guide pulley 118 is connected to a bolt 119 that is provided close to the lower end of the support 113.

In FIG. 18 the upper position of the table top 1 is shown in a solid line and the lower position of the table top 1 is shown in a dashed line. In the upper position of the table top 1 the support 113 projects from the column 112 to the maximum extent. The axis of the transverse bolt 56 in this position has the greatest distance from a vertical plane extending through the axis of the shaft 41.

When the table top 1 is lowered after releasing the arresting device, the adjusting element 36*d* is rotated counterclockwise about the adjusting shaft 41*d* with the aid of the tensioning cable 34. This results in the piston rod 45 to be pushed into the gas spring 44 so that the counterforce is correspondingly increased. Simultaneously, the effective leverage of the force-compensating device 35 is reduced. The distance between the axis of the transverse bolt 56 and the vertical plane extending through the axis of the shaft 41 is reduced upon pivoting the adjusting element 36*d* counterclockwise. Accordingly, the force which is needed for lowering the table top 1 remains constant despite the increased counterforce of the weight-compensating device in the form of the gas spring 44. The user can thus lower the table top 1 without exerting great forces.

As disclosed in connection with the embodiment of FIGS. 1 to 4, the piston rod 45 can be adjusted relative to the housing 47 of the gas spring 44 by rotating the adjusting shaft 41*d*. The further the piston rod 45 is retracted from the housing, the smaller is the resulting counterforce of the gas spring 44. Conversely, the counterforce increases when the piston rod 45 is introduced farther into the housing 47. This adjustment of the piston rod 45 relative to the housing 47 can be achieved by adjusting the position of the transverse bolt 56 within the slotted holes 54*d* of the adjusting lever 53*d* in the manner described in connection with FIGS. 1 to 4.

The force-compensating device 35 and the gas spring 44 are positioned entirely within the column 112. For receiving the support 113 a corresponding guide 120 is provided within the column 112. For releasing the non-represented arresting device a Bowden pull and/or an actuating member can be provided at the floor area of the column 112 as has been disclosed in connection with the previous embodiments.

For all embodiments the length of the force reservoir is relatively short due to the intermediate positioning of the force-compensating device comprising the adjusting element and the adjusting lever. The length of the force reservoir is smaller than the possible adjusting stroke so that the weight-compensating device can be easily fitted within the short transverse beam 9.

The present invention is, of course, in no way restricted to the specific disclosure of the specification and drawings, but also encompasses any modifications within the scope of the appended claims.

What I claim is:

1. A height-adjustable work table comprising:

a support frame comprising at least one telescopic column having at least one support slidably displaceable in said telescopic column;

a table top connected to said support;

a weight-compensating device comprising at least one force reservoir and a pulling cable for adjusting the height of said support;

a force-compensating device connected to said weight-compensating device;

said force reservoir having a first and a second end, wherein said first end of said force reservoir is connected to said support frame and said second end is connected to said force-compensating device;

said weight-compensating device cooperating with said force-compensating device such that for displacing said support the effective leverage of said force-compensating device is adjustable such that a counterforce generated by said weight-compensating device is at least partially compensated; and wherein said force-compensating device has at least one adjusting element and a tensioning cable, wherein said adjusting element comprises a support element for supporting said tensioning cable.

2. A work table according to claim 1, wherein said support element is a groove provided at a mantle surface of said adjusting element.

3. A work table according to claim 1, wherein said adjusting element has the shape of a sector.

4. A work table according to claim 1, wherein said adjusting element is a one-arm lever.

5. A work table according to claim 1, wherein said adjusting element is pivotable about a pivot axis.

6. A work table according to claim 5, wherein said support element extends concentric to said pivot axis over a portion of a circular arc.

7. A work table according to claim 6, wherein said support element extends over an angle of at least 90°.

8. A work table according to claim 1, wherein said force-compensating device further comprises a rotatable shaft and an adjusting lever, wherein said adjusting element and said adjusting lever are fixedly connected on said rotatable shaft.

9. A work table according to claim 8, wherein said adjusting lever comprises two legs.

10. A working table according to claim 9, wherein said adjusting lever is U-shaped.

11. A work table according to claim 9, wherein:

each one of said legs comprises a slotted hole extending in a longitudinal direction of each said leg;

said force-compensating device further comprises a transverse bolt; and said transverse bolt engages said slotted holes, wherein said force reservoir is connected to said transverse bolt.

12. A work table according to claim 11, wherein said transverse bolt has a threaded bore and wherein said force-compensating device further comprises:

an adjusting shaft on which said rotatable shaft is supported;

a threaded spindle with a first and a second end, said first end received in said threaded bore of said transverse bolt; and a bevel gear system connected between said second end of said threaded spindle and said adjusting shaft.

13. A work table according to claim 1, wherein said force reservoir comprises at least one gas spring.

14. A work table according to claim 1, wherein said force reservoir comprises at least one tension spring.

15. A work table according to claim 1, wherein said force reservoir comprises at least one pressure spring.

16. A work table according to claim 1, further comprising at least one arresting device for arresting said support relative to said at least one column.

17. A work table according to claim 16, wherein said at least one arresting device comprises:

a push/pull rod positioned in one of said columns and at least one locking disk connected to an upper end of said push/pull rod; and a first toothing connected to said support positioned in said one column and a second toothing connected to said at least one disk, wherein said first and second toothings cooperate with one another for arresting said support relative to said column.

18. A work table according to claim 17, wherein said at least one locking disk is movable into a release position by moving said push/pull rod.

19. A work table according to claim 18, wherein said column comprises:

a stay forming a floor support for said work table;

a lever with two arms positioned in said stay, wherein a first one of said two arms is connected to said push/pull rod; and an actuating device for pivoting said lever.

20. A work table according to claim 18, wherein said actuating device is an actuating member projecting upwardly past said stay and engages the second one of said two arms.

21. A work table according to claim 19, wherein said actuating device is a Bowden pull comprising a pull cable.

22. A work table according to claim 21, wherein said Bowden pull comprises an actuating handle.

23. A work table according to claim 22, wherein said handle comprises a holder and a grip mounted in said handle so as to be pivotable.

24. A work table according to claim 23, wherein said holder is connected to the underside of said table top.

25. A work table according to claim 21, wherein said actuating device comprises a slide connected to said first arm of said lever and wherein said pull cable is connected to said slide.

26. A work table according to claim 25, wherein said slide has at least one angled end and wherein said lever comprises a coupling part, said angled end connected to said coupling part.

27. A work table according to claim 26, wherein:

said angled end is forked;

said coupling part has an upwardly extending head; and said forked, angled end engages under said head of said coupling part.

28. A work table according to claim 23, wherein said column has a support member for said push/pull rod and wherein said slide engages said support member.

29. A work table according to claim 1, wherein said force reservoir is connected with said tensioning cable to said adjusting element.

30. A work table according to claim 1, further comprising a transverse beam connecting at least two of said columns, wherein said force-compensating device is positioned in said transverse beam.

31. A work table according to claim 1, comprising only one of said columns, wherein said force-compensating device is positioned in said column.

32. A work table according to claim 1, comprising two of said columns and further comprising a parallel guide system connected to said supports.

* * * * *